US008700200B2

(12) United States Patent
Tokura

(10) Patent No.: US 8,700,200 B2
(45) Date of Patent: Apr. 15, 2014

(54) SEWING MACHINE AND NON-TRANSITORY COMPUTER-READABLE MEDIUM STORING SEWING MACHINE CONTROL PROGRAM

(75) Inventor: Masashi Tokura, Nagoya-shi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 250 days.

(21) Appl. No.: 13/105,426

(22) Filed: May 11, 2011

(65) Prior Publication Data

US 2011/0282479 A1 Nov. 17, 2011

(30) Foreign Application Priority Data

May 12, 2010 (JP) ..... 2010-110101

(51) Int. Cl.
*G06F 7/66* (2006.01)

(52) U.S. Cl.
USPC ..... 700/136; 112/102.5; 112/470.04

(58) Field of Classification Search
USPC ..... 700/136–138; 112/102.5, 103, 470.01, 112/470.03, 470.04, 470.06, 475.18, 475.19
See application file for complete search history.

(56) References Cited

U.S. PATENT DOCUMENTS

| | | | | |
|---|---|---|---|---|
| 4,876,976 | A | 10/1989 | Brower et al. | |
| 4,998,489 | A | 3/1991 | Hisatake et al. | |
| 5,095,835 | A * | 3/1992 | Jernigan et al. | 112/475.05 |
| 5,319,565 | A * | 6/1994 | Hausammann et al. | 700/138 |
| 5,911,182 | A | 6/1999 | Uyama et al. | |
| 6,000,350 | A | 12/1999 | Koike et al. | |
| 6,167,822 | B1 * | 1/2001 | Miyasako et al. | 112/102.5 |
| 6,189,467 | B1 * | 2/2001 | Tomita | 112/102.5 |
| 6,263,815 | B1 * | 7/2001 | Furudate | 112/470.13 |
| 7,702,415 | B2 * | 4/2010 | Roos | 700/138 |
| 2005/0234585 | A1 | 10/2005 | Muto et al. | |
| 2006/0096510 | A1 | 5/2006 | Kuki et al. | |
| 2009/0188413 | A1 | 7/2009 | Hirata et al. | |
| 2009/0188414 | A1 | 7/2009 | Tokura | |

FOREIGN PATENT DOCUMENTS

| | | |
|---|---|---|
| EP | 0 971 061 A1 | 1/2000 |
| JP | A-2-57288 | 2/1990 |
| JP | A-6-327867 | 11/1994 |
| JP | A-8-294589 | 11/1996 |
| JP | A-8-294590 | 11/1996 |
| JP | A-11-99294 | 4/1999 |
| JP | A-2005-185297 | 7/2005 |
| JP | A-2005-279008 | 10/2005 |
| JP | A-2006-6977 | 1/2006 |
| JP | A-2006-130124 | 5/2006 |
| JP | A-2009-172119 | 8/2009 |
| JP | A-2009-172123 | 8/2009 |

OTHER PUBLICATIONS

Extended European Search Report issued in European Patent Application No. 11165829.0 dated Sep. 13, 2011.

* cited by examiner

*Primary Examiner* — Nathan Durham
(74) *Attorney, Agent, or Firm* — Oliff PLC

(57) ABSTRACT

A sewing machine includes a needle bar to a lower end of which a needle can be attached, a needle plate in which a needle hole is provided, an image capture device that generates, as captured image data, data that describe a captured image of a sewing object being positioned between the needle bar and the needle plate, a marker data generation device that generates, as marker data, data that describe a setting marker, the setting marker indicating a pattern position and a pattern angle, a composite image data generation device that generates, as composite image data, data that describe a composite image based on the captured image data and the marker data, and a display control device that, based on the composite image data, causes the composite image to be displayed on a screen.

12 Claims, 19 Drawing Sheets

SEWING MACHINE AND NON-TRANSITORY COMPUTER-READABLE MEDIUM STORING SEWING MACHINE CONTROL PROGRAM

CROSS-REFERENCE TO RELATED APPLICATION

This application claims priority to Japanese Patent Application No. 2010-110101, filed May 12, 2010, the content of which is hereby incorporated herein by reference.

BACKGROUND

The present disclosure relates to a sewing machine that includes an image capture device and to a non-transitory computer-readable medium that stores a sewing machine control program.

A sewing machine is known that, in accordance with a command from a user, selects an embroidery pattern and positions the embroidery pattern on an object to be sewn (hereinafter referred to as a "sewing object") (for example, refer to Japanese Laid-Open Patent Publication No. 2-57288). Based on image data that have been generated by an image capture device, this sort of sewing machine creates an image in which an image that depicts the selected embroidery pattern is superimposed on an image that depicts the sewing object. The sewing machine also displays the created image. The image that depicts the embroidery pattern is positioned by designating a starting point and an ending point of the image that depicts the embroidery pattern within the image that depicts the sewing object.

SUMMARY

In the known sewing machine, an image capture area of the image capture device is fixed. It is assumed that an embroidery pattern whose size exceeds the image capture area will not be used. However, the size of the embroidery pattern may exceed the image capture area of the image capture device, for example. In such a case, the user cannot use the known sewing machine to check whether the embroidery pattern has been positioned as the user intended, even if the user looks at the screen that displays the image of the embroidery pattern superimposed on the captured image of the sewing object.

Various exemplary embodiments of the broad principles derived herein provide a sewing machine and a non-transitory computer-readable medium that stores a sewing machine control program that allow a user to check positioning of an embroidery pattern on a sewing object by utilizing a captured image of the sewing object, even in a case where a size of the embroidery pattern exceeds an image capture area of an image capture device.

Exemplary embodiments provide a sewing machine that includes a needle bar to a lower end of which a needle can be attached, a needle plate in which a needle hole is provided, the needle can pass through the needle hole, an image capture device that generates, as captured image data, data that describe a captured image of a sewing object being positioned between the needle bar and the needle plate, and a marker data generation device that generates, as marker data, data that describe a setting marker. The setting marker indicates a pattern position and a pattern angle. The pattern position is a position of a reference point of an embroidery pattern in relation to the sewing object. The pattern angle is an angle of the embroidery pattern in relation to the sewing object. The sewing machine also includes a composite image data generation device that generates, as composite image data, data that describe a composite image based on the captured image data and the marker data, the composite image being an image in which the setting marker is superimposed on at least a portion of the captured image, in a position indicated by the marker data, and a display control device that, based on the composite image data, causes the composite image to be displayed on a screen.

Exemplary embodiments also provide a non-transitory computer-readable medium storing a control program executable on a sewing machine. The program includes instructions that cause a computer of the sewing machine to perform the steps of causing an image capture device of the sewing machine to generate, as captured image data, data that describe a captured image of a sewing object being positioned between a needle bar of the sewing machine and a needle plate of the sewing machine, and generating, as marker data, data that describe a setting marker. The setting marker indicates a pattern position and a pattern angle. The pattern position is a position of a reference point of an embroidery pattern in relation to the sewing object. The pattern angle is an angle of the embroidery pattern in relation to the sewing object. The program also includes instructions that cause the computer to perform the steps of generating, as composite image data, data that describe a composite image based on the captured image data and the marker data, the composite image being an image in which the setting marker is superimposed on at least a portion of the captured image, in a position indicated by the marker data, and causing the composite image to be displayed on a screen, based on the composite image data.

BRIEF DESCRIPTION OF THE DRAWINGS

Exemplary embodiments will be described below in detail with reference to the accompanying drawings in which.

DETAILED DESCRIPTION

Hereinafter, a multi-needle sewing machine (hereinafter referred to as a "sewing machine") 1 that is an embodiment will be explained with reference to the drawings. The referenced drawings are used for explaining technical features that may be utilized in the present disclosure, and the device configurations and the like that are described are simply explanatory examples that do not limit the present disclosure to only those configurations and the like.

The physical configuration of the sewing machine 1 will be explained with reference to FIGS. 1 and 2. In the explanation that follows, in FIG. 1, the lower left side, the upper right side, the upper left side, and the lower right side of the page respectively correspond to the front, the rear, the left, and the right of the sewing machine 1.

Figure 1:
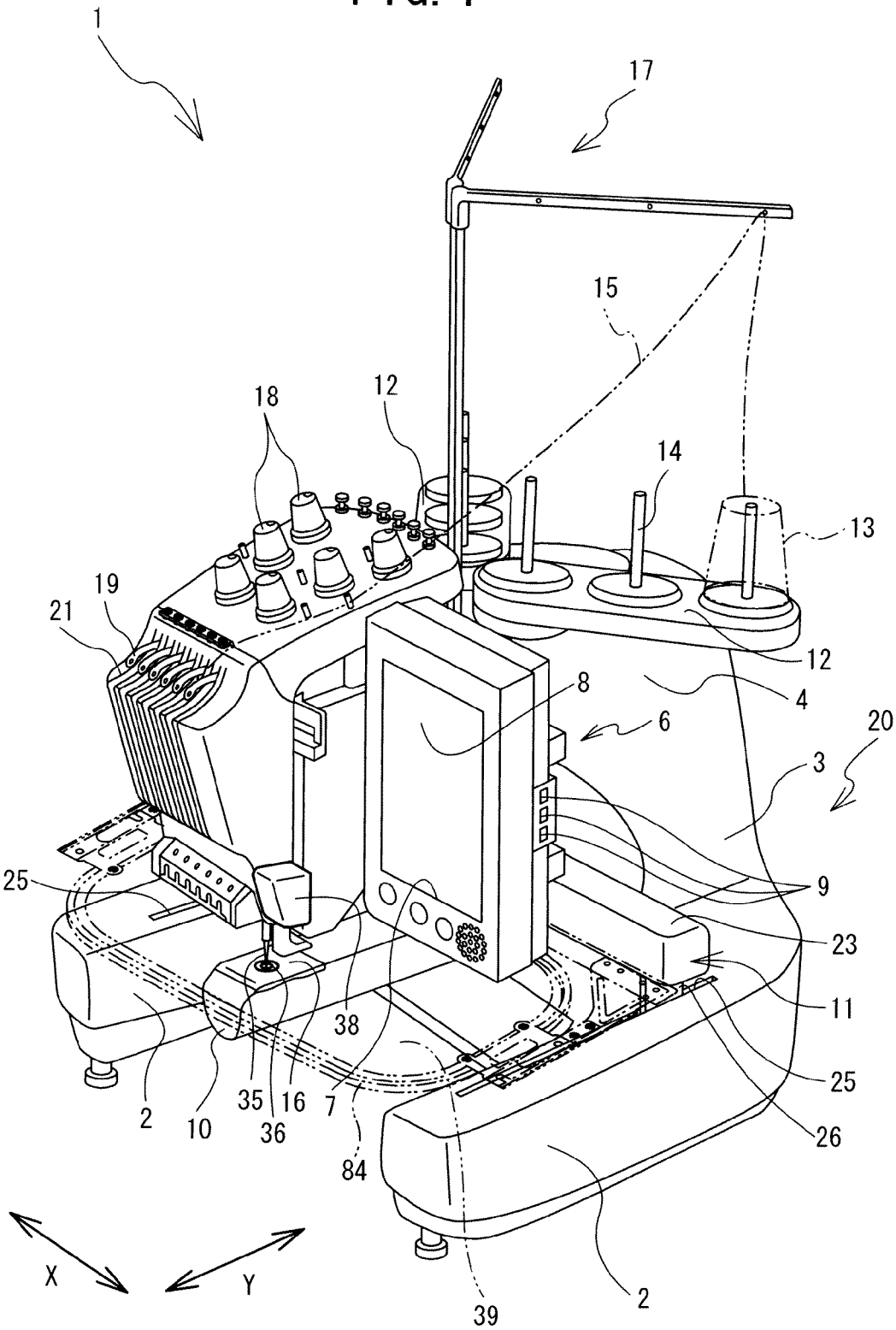
FIG. 1 is an oblique view of a multi-needle sewing machine 1.
Figure 2:
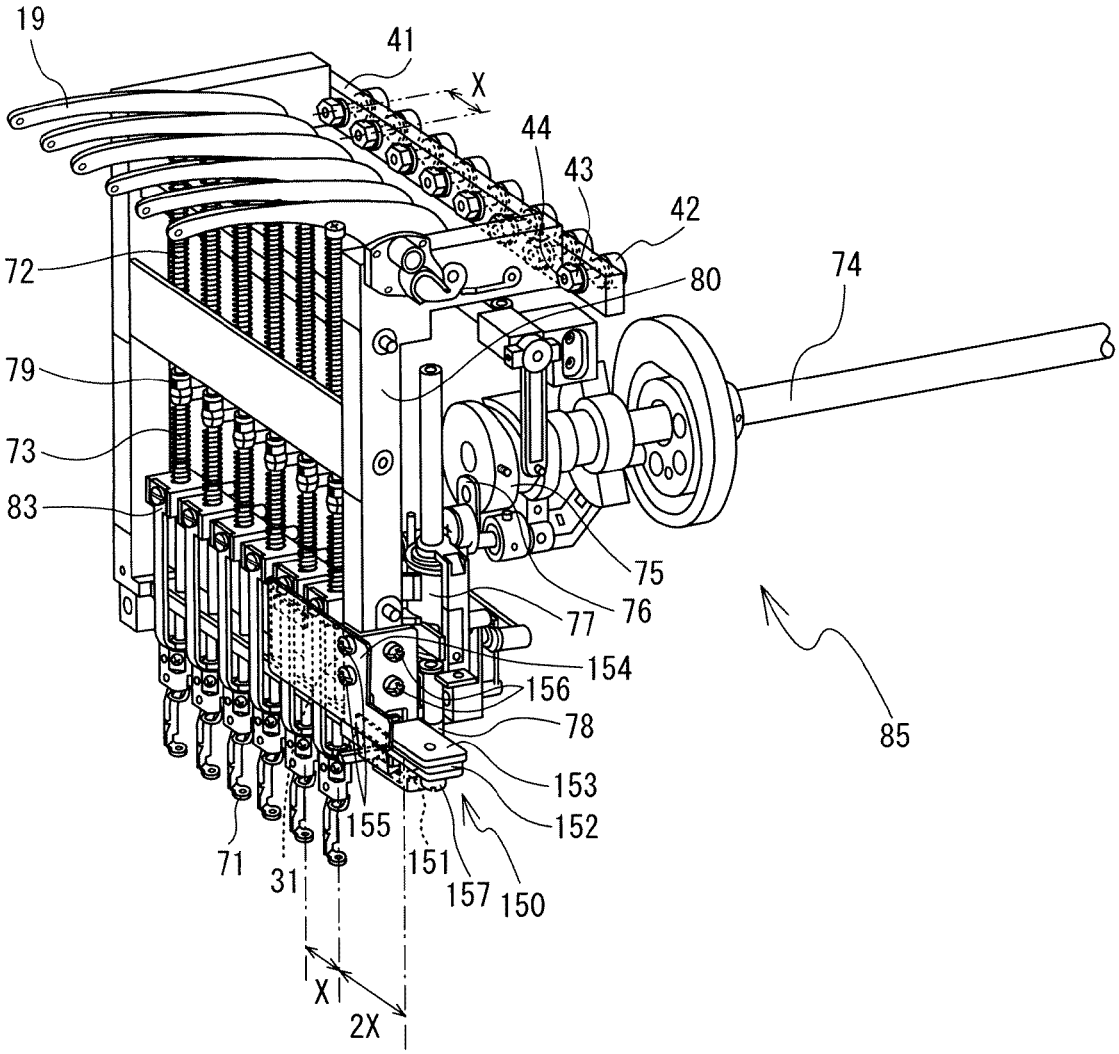
FIG. 2 is an oblique view of a needle bar drive mechanism 85 that is located inside a needle bar case 21.

As shown in FIG. 1, the sewing machine 1 includes a supporting portion 2, a pillar 3, and an arm 4. The supporting portion 2 is formed in an inverted U shape in a plan view, and supports the entire sewing machine 1. A pair of left and right guide slots 25 that extend in a front-rear direction is provided on the to face of the supporting portion 2. The pillar 3 extends upward from the rear end of the supporting portion 2. The arm 4 extends forward from the upper end of the pillar 3. A needle bar case 21 is mounted on the front end of the arm 4 such that the needle bar case 21 can be moved to the left and to the right. The needle bar case 21 will be described in detail below.

An operation portion 6 is provided on the right side of the arm 4 at a central position in the front-rear direction. A vertically extending shaft (not shown in the drawings) serves as an axis of rotation on which the operation portion 6 is pivotally supported by the arm 4. The operation portion 6 includes a liquid crystal display (LCD) 7, a touch panel 8, and connectors 9. An operation screen for a user to input commands, for example, may be displayed on the LCD 7. The touch panel 8 may be used to accept commands from the user. The user may use a finger, a stylus pen, or the like to touch a position of the touch panel 8 that corresponds to a position of an image that is displayed on the LCD 7 and that shows an input key or the like so that the user can select a sewing pattern, sewing condition, and the like. Hereinafter, an operation touching the touch panel 8 is referred to as a "panel operation". The connectors 9 are USB standard connectors, to which a USB device 160 (refer to FIG. 5) can be connected.

A cylinder bed 10 that extends forward from the bottom end of the pillar 3 is provided underneath the arm 4. A shuttle (not shown in the drawings) is provided in the interior of the front end of the cylinder bed 10. A bobbin (not shown in the drawings) on which a lower thread (not shown in the drawings) is wound may be accommodated in the shuttle. A shuttle drive mechanism (not shown in the drawings) is also provided in the interior of the cylinder bed 10. The shuttle drive mechanism rotationally drives the shuttle. A needle plate 16 that is rectangular in a plan view is provided on the top face of the cylinder bed 10. A needle hole 36 through which a needle 35 can pass is provided in the needle plate 16.

Figure 4:
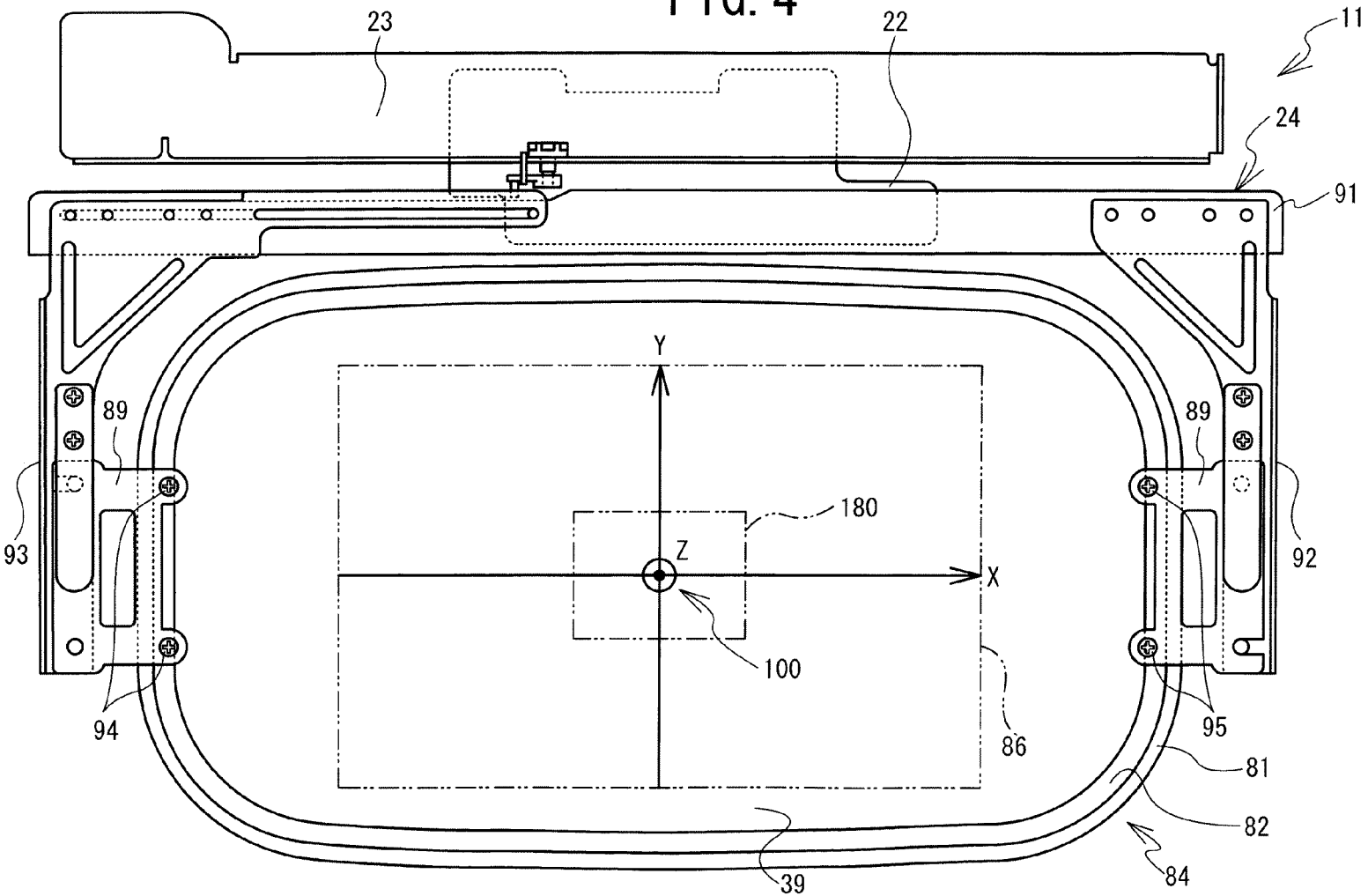
FIG. 4 is a plan view of an embroidery frame moving mechanism 11.

An embroidery frame moving mechanism 11 shown in FIG. 4 is provided underneath the arm 4. The sewing machine 1 performs sewing of an embroidery pattern on a sewing object 39 that is held by an embroidery frame 84 as the embroidery frame 84 is moved to the left and the right, and forward and backward, by an X axis motor 132 (refer to FIG. 5) and a Y axis motor 134 (refer to FIG. 5) of the embroidery frame moving mechanism 11. The embroidery frame moving mechanism 11 will be described in detail below.

A right-left pair of spool platforms 12 are provided at the rear face side of the top face of the arm 4. Three thread spool pins 14 are provided on each of the spool platforms 12. The thread spool pins 14 are pins that extend in the vertical direction. The thread spool pins 14 pivotally support thread spools 13. The number of the thread spools 13 that can be placed on the one pair of the spool platforms 12 is six, the same as the number of needle bars 31. Upper threads 15 may be supplied from the thread spools 13 that are attached to the spool platforms 12. Each of the upper threads 15 may be supplied, through a thread guide 17, a tensioner 18, and a thread take-up lever 19, to an eye (not shown in the drawings) of each of the needles 35 that are attached to the bottom ends of the needle bars 31 (refer to FIG. 2) respectively.

Figure 3:
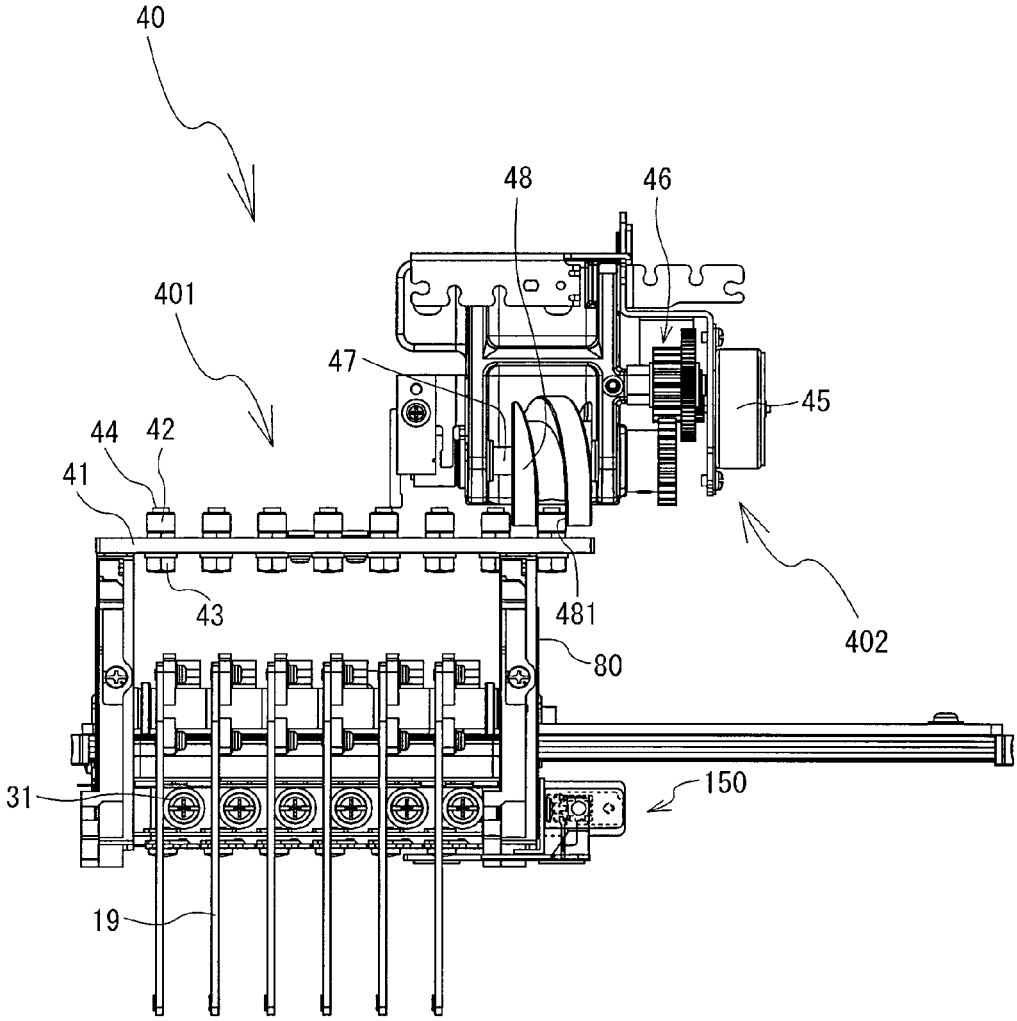
FIG. 3 is a plan view of a needle bar case moving mechanism 40.

Next, an internal mechanism of the needle bar case 21 will be explained with reference to FIGS. 2 and 3. In FIG. 3, the lower side, the upper side, the left side, and the right side of the page respectively correspond to the front, the rear, the right, and the left of the sewing machine 1. As shown in FIGS. 2 and 3, the six needle bars 31, which extend in the vertical direction, are provided inside the needle bar case 21 at equal intervals X in the left-right direction. Needle bar numbers are respectively assigned to the needle bars 31 in order to identify the individual needle bars 31. In the present embodiment, the needle bar numbers 1 to 6 are assigned to the needle bars 31 in order starting from the right side in FIG. 3. The needle bars 31 are supported by two upper and lower securing members (not shown in the drawings) that are secured to a frame 80 of the needle bar case 21 such that the needle bars 31 can slide up and down. A needle bar follow spring 72 is provided on the upper half of each of the needle bars 31. A presser spring 73 is provided on the lower half of each of the needle bars 31. A needle bar guide 79 is provided between the needle bar follow spring 72 and the presser spring 73. A presser guide 83 is provided below the presser spring 73. The needle bars 31 are slid up and down by a needle bar drive mechanism 85. The needle bar drive mechanism 85 includes a sewing machine motor 122 (refer to FIG. 5), a thread take-up lever drive cam 75, a coupling member 76, a transmitting member 77, a guide bar 78, and a coupling pin (not shown in the drawings). The sewing machine motor 122 is a drive source for the needle bar drive mechanism 85. The needles 35 (refer to FIG. 1) may be attached to the bottom ends of the needle bars 31. A presser foot 71 extends from each of the presser guides 83 to slightly below the bottom end portion (the tip portion) of the corresponding needle 35. A presser foot 71 operates in conjunction with the up-and-down movement of the corresponding needle bar 31, and intermittently presses the sewing object 39 (refer to FIG. 1) downward.

An image sensor holding mechanism 150 is attached to the lower portion of the right side face of the frame 80. The image sensor holding mechanism 150 includes an image sensor 152, a holder 152, a supporting member 153, and a connecting plate 154. The image sensor 151 is a known complementary metal oxide semiconductor (CMOS) image sensor. The holder 152 supports the image sensor 151 in a state in which a lens (not shown in the drawings) of the image sensor 151 faces downward. The center of the lens of the image sensor 151 is in a position that is at a distance 2X from the needle bar 31 that is the farthest to the right. The supporting member 153 has an L shape when viewed from the front. The supporting member 153 supports the connecting plate 154 and the holder 152. The supporting member 153 is secured to the lower portion of the right side face of the frame 80 by screws 156. The holder 152 is secured to the bottom face of the supporting member 153 by a screw 157. The connecting plate 154 is a plate that is L-shaped when viewed from the front. The connecting plate 154 electrically connects the image sensor 151 to a control portion 140 that will be described below (refer to FIG. 5). The connecting plate 154 is secured to the front face of the supporting member 153 by screws 155. The front face, the top face, and the right side face of the image sensor holding mechanism 150 are covered by a cover 38 (refer to FIG. 1).

A needle bar case moving mechanism 40 will be explained with reference to FIGS. 2 and 3. The needle bar case moving mechanism 40 moves the needle bar case 21.

As shown in FIG. 3, the needle bar case moving mechanism 40 includes an engaging roller portion 401 and a needle bar case drive portion 402. The engaging roller portion 401 includes a plate 41 that is long in the left-right direction, engaging rollers 42, nuts 43, and shoulder bolts 44. As shown in FIGS. 2 and 3, the plate 41 is attached to the upper rear edge of a frame 80. Each of the eight engaging rollers 42 is attached to rear face of the plate 41 by one of the shoulder bolts 44. Although not shown in detail in the drawings, each of the engaging rollers 42 has a round cylindrical shape. The engaging rollers 42 are supported by the shoulder bolts 44 such that the engaging rollers 42 can rotate, but cannot move in the axial direction of the engaging rollers 42. Each of the shoulder bolts 44 is inserted into a hole in the plate 41 (not shown in the drawings) and is secured by one of the nuts 43. The intervals between the engaging rollers 42 in the left-right direction are the same X as the intervals between the needle bars 31 in the left-right direction. The height positions at which the eight engaging rollers 42 are attached are all the same.

The needle bar case drive portion 402 is located in the rear of the plate 41 in the interior of the arm 4 (refer to FIG. 1). The needle bar case drive portion 402 includes a needle bar case motor 45, a gear portion 46, a rotating shaft 47, and a helical cam 48. The needle bar case motor 45 is a pulse motor. The needle bar case motor 45 is secured such that the axial direction of an output shaft (not shown in the drawings) is the left-right direction. The needle bar case motor 45 rotates the helical cam 48 by a specified amount by transmitting power to the rotating shaft 47 through the gear portion 46. The rotating shaft 47 is supported in parallel to the output shaft of the needle bar case motor 45. The helical cam 48 is secured to the outer circumference of the rotating shaft 47. The helical cam 48 is constantly engaged with one of the eight engaging rollers 42. The helical cam 48 includes a positioning portion 481. In a case where the rotation of the rotating shaft 47 is stopped, one of the eight engaging rollers 42 is engaged with the positioning portion 481 of the helical earn 48. In the state in which one of the eight engaging rollers 42 is engaged with the positioning portion 481, when the rotating shaft 47 is rotated through a specified angle of the rotation, the position, in the left-right direction, of the engaging roller 42 that is engaged with the helical cam 48 remains the same before and after the rotation of the rotating shaft 47.

The operation of moving the needle bar case 21 will be explained with reference to FIGS. 2 and 3. The needle bar case 21 is moved by the needle bar case moving mechanism 40 in the left-right direction (the horizontal direction) in relation to a body 20 of the sewing machine 1 (refer to FIG. 1). With each full revolution of the helical cam 48, the needle bar case moving mechanism 40 moves the needle bar case 21 a distance X in the left-right direction. The direction in which the needle bar case 21 is moved is determined in accordance with the direction of rotation of the helical cam 48. In a case where the helical cam 48 rotates counterclockwise as seen from the right side, the needle bar case 21 is moved to the left. In a case where the helical cam 48 rotates clockwise as seen from the right side, the needle bar case 21 is moved to the right.

Numbers from 1 to 8 are assigned to the engaging rollers 42, in accordance with the positions of the engaging rollers 42, starting from the left. A state in which the positioning portion 481 is engaged with the number 6 engaging roller 42, for example, may be deemed to be an initial position. In this state, the needle bar 31 with the needle bar number 1 is positioned directly above the needle hole 36. When the helical cam 48 is rotated clockwise as seen from the right, the number 6 engaging roller 42 is slid toward the right by the helical cam 48, and the frame 80 starts moving toward the right in relation to the body 20 (refer to FIG. 1). Next, the engagement of the number 6 engaging roller 42 with the helical cam 48 is released, and the number 5 engaging roller 42 engages with the helical cam 48. Thus, when the helical cam 48 is rotated clockwise one full revolution from the initial position as seen from the right, the frame 80 is moved toward the right by the distance X, and the needle bar 31 with the needle bar number 2 is positioned directly above the needle hole 36. In contrast, when the helical cam 48 is rotated counterclockwise one full revolution as seen from the right, the frame 80 is moved toward the left by the distance X. Thus, for every full revolution of the helical cam 48, the needle bar case moving mechanism 40 moves the frame 80 by the distance X toward one of the left and the right, depending on the direction of rotation of the helical cam 48.

The image sensor holding mechanism 150 is fastened to the frame 80. Therefore, the position of the image sensor 151 in relation to the body 20 is changed by moving the needle bar case 21. In a case where the number 8 engaging roller 42 is engaged with the positioning portion 481, the image sensor 151 is at an image capture position. At the image capture position, the image sensor 151 is positioned directly above the needle hole 36.

The embroidery frame 84 and the embroidery frame moving mechanism 11 will be explained with reference to FIG. 4. The embroidery frame 84 includes an outer frame 81, and inner frame 82, and a left-right pair of coupling portions 89. The embroidery frame 84 holds the sewing object 39 clamped between the outer frame 81 and the inner frame 82. Each of the coupling portions 89 is a plate-shaped member that is rectangular in a plan view and that has a rectangular cut-out in a central portion of the plate-shaped member. One of the coupling portions 89 is fastened by a screw 95 to the right-hand portion of the inner frame 82. The other of the coupling portions 89 is fastened by a screw 94 to the left-hand portion of the inner frame 82. A plurality of types of embroidery frames other than the embroidery frame 84, with different sizes and shapes, can be mounted in the sewing machine 1. Of the embroidery frames that can be used in the sewing machine 1, the embroidery frame 84 is the embroidery frame with the greatest width in the left-right direction (the greatest distance between the coupling portions 89 in the left-right direction). A sewing area 86 is defined in an area on the inner side of the inner frame 82, in accordance with the type of the embroidery frame 84.

The embroidery frame moving mechanism 11 includes a holder 24, an X carriage 22, an X axis drive mechanism (not shown in the drawings), a Y carriage 23, and a Y axis drive mechanism (not shown in the drawings). The holder 24 supports the embroidery frame 84 such that the embroidery frame 84 can be attached to and detached from the holder 24. The holder 24 includes an attaching portion 91, a right arm portion 92, and a left arm portion 93. The attaching portion 91 is a plate member that is rectangular in a plan view, with its long sides running in the left-right direction. The right arm portion 92 is a plate member that extends in the front-rear direction and is secured to the right end of the attaching portion 91. The left arm portion 93 is a plate member that extends in the front-rear direction, and is attached to the left portion of the attaching portion 91. The left arm portion 93 is secured such that the position of the left arm portion 93 can be adjusted in the left-right direction in relation to the attaching portion 91. The right arm portion 92 is engaged with one of the coupling portions 89, and the left arm portion 93 is engaged with the other of the coupling portions 89.

The X carriage 22 is a plate member, with its long dimension running in the left-right direction. A portion of the X carriage 22 projects forward from the front end of the Y carriage 23. The attaching portion 91 of the holder 24 is attached to the X carriage 22. The X axis drive mechanism includes the X axis motor 132 (refer to FIG. 5) and a linear movement mechanism (not shown in, the drawings). The X axis motor 132 is a stepping motor. The linear movement mechanism includes a timing pulley (not shown in the drawings) and a timing belt (not shown in the drawings). The linear movement mechanism moves the X carriage 22 to the left and to the right (in the X axis direction) using the X axis motor 132 as its drive source.

The Y carriage 23 has a box shape, with its long dimension running in the left-right direction. The Y carriage 23 supports the X carriage 22 such that the X carriage 22 can move to the left and to the right. The Y axis drive mechanism (not shown in the drawings) includes a pair of left and right moving bodies 26 (refer to FIG. 1), the Y axis motor 134 (refer to FIG. 5), and a linear movement mechanism (not shown in the drawings). The moving bodies 26 are coupled to the bottom portions of the left and right ends of the Y carriage 23 respectively and pass vertically through the guide slots 25 (refer to FIG. 1). The Y axis motor 134 is a stepping motor. The linear movement mechanism includes a timing pulley (not shown in the drawings) and a timing belt (not shown in the drawings). The linear movement mechanism moves the moving bodies 26 forward and backward (in the Y axis direction) along the guide slots 25 using the Y axis motor 134 as its drive source. In conjunction with the movement of the moving bodies 26, the Y carriage 23, which is coupled to the moving bodies 26, and the X carriage 22, which is supported by the Y carriage 23, move forward and backward (in the Y axis direction). In a state in which the embroidery frame 84 that holds the sewing object 39 is mounted on the X carriage 22, the sewing object 39 is positioned between the needle bars 31 and the needle plate 16.

The operation that forms a stitch on the sewing object 39 held by the embroidery frame 84 will be explained with reference to FIGS. 1 to 5. The embroidery frame 84 that holds the sewing object 39 is supported by the holder 24 of the embroidery frame moving mechanism 11 (refer to FIGS. 1 and 4). First, one of the six needle bars 31 is selected by the moving of the needle bar case 21 in the left-right direction. The embroidery frame 84 is moved to a specified position by the embroidery frame moving mechanism 11. The needle bar drive mechanism 85 is driven when a drive shaft 74 is rotated by the sewing machine motor 122. The rotational movement of the drive shaft 74 is transmitted to the coupling member 76 through the thread take-up lever drive cam 75. The coupling member 76 is pivotally supported on the transmitting member 77. The guide bar 78 is positioned parallel to the needle bar 31. The transmitting member 77 is guided by the guide bar 78 and is driven up and down. The up-and-down movement is transmitted to the needle bar 31 through the coupling pin (not shown in the drawings), and the needle bar 31, to which the needle 35 is attached, is driven up and down. Through a link mechanism, which is not shown in detail in the drawings, the thread take-up lever 19 is driven up and down by the rotation of the thread take-up lever drive cam 75. Furthermore, the rotation of the drive shaft 74 is transmitted to the shuttle drive mechanism (not shown in the drawings), and the shuttle (not shown in the drawings) is rotationally driven. Thus the needle 35, the thread take-up lever 19, and the shuttle are driven in synchronization, and a stitch is formed on the sewing object 39.

Figure 5:
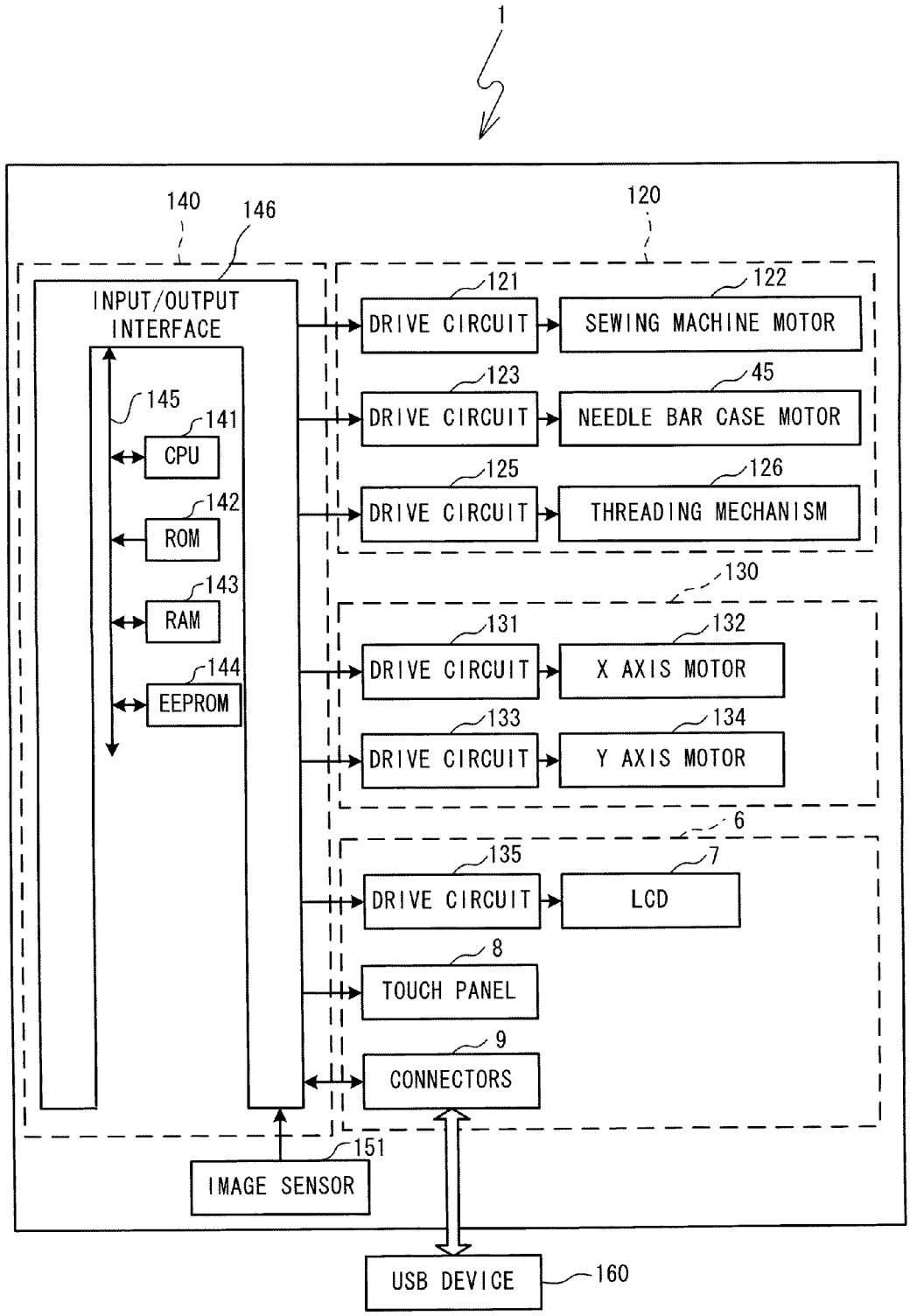
FIG. 5 is a block diagram that shows an electrical configuration of the multi-needle sewing machine 1.

The electrical configuration of the sewing machine 1 will be explained with reference to FIG. 5. As shown in FIG. 5, the sewing machine 1 includes a needle drive portion 120, a sewing object drive portion 130, the operation portion 6, the image sensor 151, and the control portion 140.

The needle drive portion 120 includes drive circuits 121, 123, 125, the sewing machine motor 122, the needle bar case motor 45, and a threading mechanism 126. The sewing machine motor 122 moves the needle bars 31 reciprocally up and down. The drive circuit 121 drives the sewing machine motor 122 in accordance with a control signal from the control portion 140. The needle bar case motor 45 moves the needle bar case 21 to the left and to the right in relation to the body 20. The drive circuit 123 drives the needle bar case motor 45 in accordance with a control signal from the control portion 140. The threading mechanism 126 is provided below the front end of the arm 4, although not shown in detail in the drawings. The threading mechanism 126 is used for passing the upper thread 15 (refer to FIG. 1) through the eye (not shown in the drawings) of the needle 35 that is attached to the needle bar 31 that is positioned directly above the needle hole 36. A drive circuit 125 drives the threading mechanism 126 in accordance with a control signal from the control portion 140.

The sewing object drive portion 130 includes drive circuits 131, 133, the X axis motor 132, and the Y axis motor 134. The X axis motor 132 moves the embroidery frame 84 (refer to FIG. 1) to the left and to the right. The drive circuit 131 drives the X axis motor 132 in accordance with a control signal from the control portion 140. The Y axis motor 134 moves the embroidery frame 84 forward and backward. The drive circuit 133 drives the Y axis motor 134 in accordance with a control signal from the control portion 140.

The operation portion 6 includes the touch panel 8, the connectors 9, a drive circuit 135, and the LCD 7. The drive circuit 135 drives the LCD 7 in accordance with a control signal from the control portion 140. The connectors 9 are provided with functions that connect to the USB device 160. The USB device 160 may be a personal computer, a USB memory, or another sewing machine 1, for example.

The control portion 140 includes a CPU 141, a ROM 142, a RAM 143, an EEPROM 144, and an input/output interface 146, all of which are connected to one another by a bus 145.

The needle drive portion 120, the sewing object drive portion 130, the operation portion 6, and the image sensor 151 are each connected to the input/output interface 146.

The CPU 141 conducts main control over the sewing machine 1. The CPU 141 executes various types of computations and processing that are related to sewing in accordance with various types of programs stored in a program storage area (not shown in the drawings) in the ROM 142. The programs may be stored in an external storage device such as a flexible disk.

The ROM 142 includes a plurality of storage areas that include the program storage area and a pattern storage area, which are not shown in the drawings. Various types of programs for operating the sewing machine 1, including a main program, are stored in the program storage area. The main program is a program for executing main processing that will be described below. Embroidery data for sewing embroidery patterns are stored in the pattern storage area in association with pattern IDs. The pattern IDs are used in processing that specifies an embroidery pattern.

The RAM 143 is a storage element that can be read from and written to as desired. The RAM 143 includes storage areas that store computation results and the like from computational processing by the CPU 141 as necessary. The EEPROM 144 is a storage element that can be read from and written to. Various types of parameters for the sewing machine 1 to execute various types of processing are stored in the EEPROM 144. Internal parameters and external parameters for the image sensor 151 are stored in the EEPROM 144, for example. The internal parameters for the image sensor 151 are parameters to correct a shift in focal length, a shift in principal point coordinates, and distortion of a captured image due to properties of the image sensor 151. The external parameters for the image sensor 151 are parameters that indicate the installed state (the position and the orientation) of the image sensor 151 with respect to a world coordinate system. The world coordinate system is a coordinate system that represents the whole of space. The world coordinate system is not influenced by the center of gravity etc. of a subject.

The embroidery data according to the present embodiment will be explained. The embroidery data include coordinate data for an embroidery coordinate system 100 shown in FIG. 4. The embroidery coordinate system 100 is a coordinate system for the X axis motor 132 and the Y axis motor 134 that move the X carriage 22. The coordinate data for the embroidery coordinate system 100 describe the position and the angle of the embroidery pattern in relation to the X carriage 22. The embroidery frame 84 that holds the sewing object 39 is mounted on the X carriage 22. Therefore, the coordinate data for the embroidery coordinate system 100 describe the position and the angle of the embroidery pattern in relation to the sewing object 39 that is held by the embroidery frame 84. In the present embodiment, the embroidery coordinate system 100 corresponds to the world coordinate system in advance. As shown in FIG. 4, in the embroidery coordinate system 100, the direction from the left to the right in the sewing machine 1 is the positive direction on the X axis, and the direction from the front to the rear in the sewing machine 1 is the positive direction on the Y axis. In the present embodiment, the initial position of the embroidery frame 84 is defined as being at the origin point (X, Y, Z)=(0, 0, 0) of the embroidery coordinate system 100. When the embroidery frame 84 is in the initial position, the center point of the sewing area 86 that corresponds to the embroidery frame 84 is aligned with a needle drop point. The needle drop point is the point where the needle 35 that is positioned directly above the needle hole 36 (refer to FIG. 2) pierces the sewing object 39 when the needle bar 31 is moved downward from a state of being above the sewing object 39. The embroidery frame moving mechanism 11 according to the present embodiment does not move the embroidery frame 84 in the Z axis direction (the up-down direction in the sewing machine 1). Therefore, as long as the thickness of the sewing object 39 can be ignored, the upper surface of the sewing object 39 is defined as having a Z axis coordinate of zero.

The coordinate data in the embroidery data stored in the ROM 142 specify an initial position for the embroidery pattern. The initial position for the embroidery pattern is set such that the center point of the embroidery pattern coincides with the center point of the sewing area 86. In a case where the position of the embroidery pattern has changed in relation to the sewing object 39, the coordinate data in the embroidery data are corrected as necessary. In the first to the third embodiments, the position of the embroidery pattern in relation to the sewing object 39 is set in accordance with the main processing that is described below. In the explanation that follows, the data that are expressed in the embroidery coordinate system 100 are used to set the position of (the center point of) the embroidery pattern and the angle of the embroidery pattern in relation to the sewing object 39 that is held by the embroidery frame 84.

An image capture area of the image sensor 151 will be explained. In a case where the image sensor 151 is positioned at the image capture position, the image capture area of the image sensor 151 in the XY plane of the embroidery coordinate system 100 is a rectangular area with its center at a point that is directly below the center of the lens of the image sensor 151. The length of the rectangular area in the left-right direction is approximately 80 millimeters, and the length of the rectangular area in the front-rear direction is approximately 60 millimeters. In a case where the image sensor 151 is positioned at the image capture position and the embroidery frame 84 is positioned at the initial position, an image capture area 180 is a rectangular area with its center at the origin point of the embroidery coordinate system 100, as shown in FIG. 4.

Figure 6:
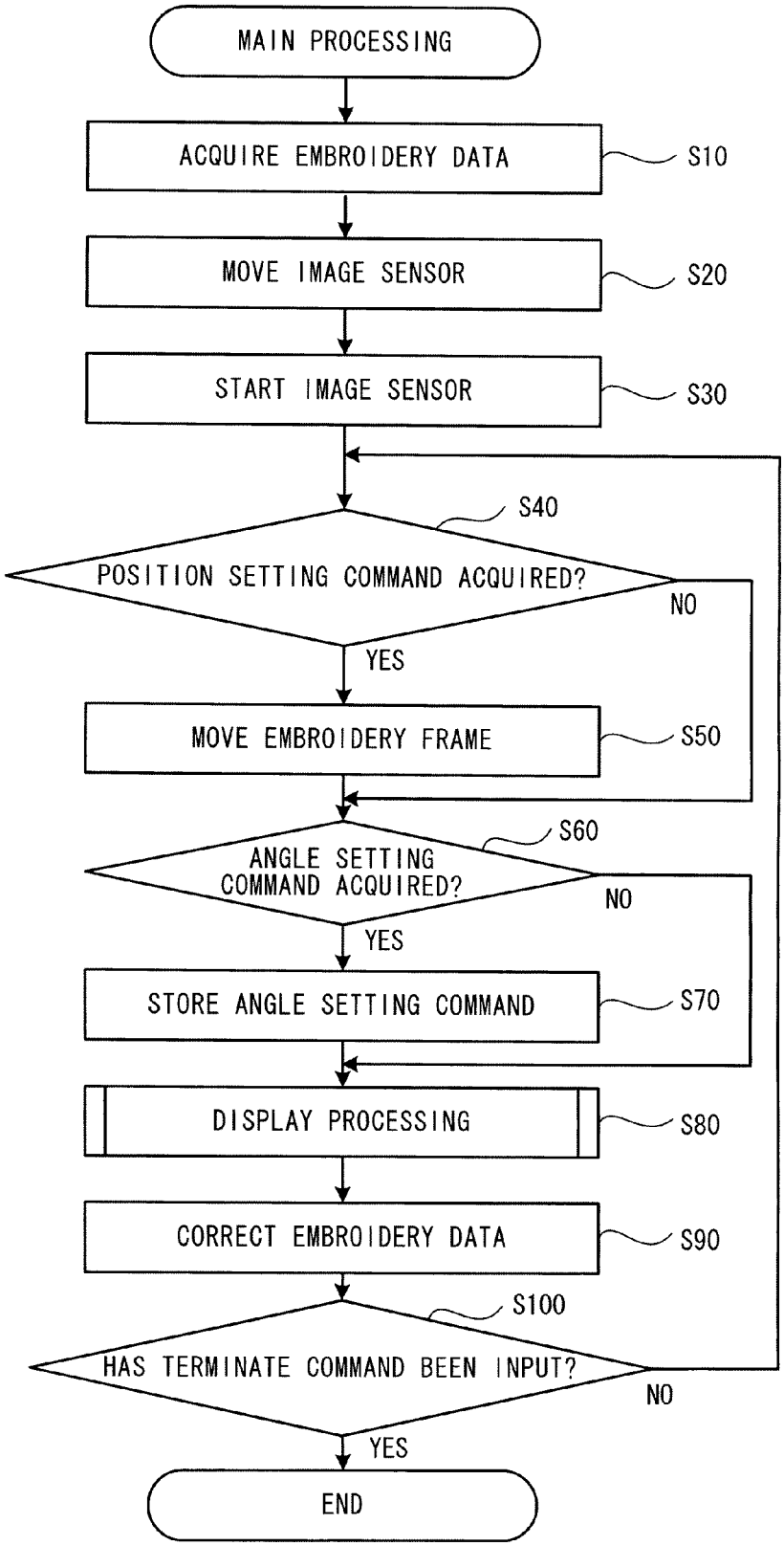
FIG. 6 is a flowchart of main processing.

The main processing in the sewing machine 1 according to the first embodiment will be explained with reference to FIGS. 6 to 15. The CPU 41 performs the main processing shown in FIG. 6 in accordance with the main program stored in the ROM 142. The main processing shown in FIG. 6 is started when a start command is input by a panel operation. For example, the user may input the start command in a case where the user has selected the embroidery pattern that will be sewn on the sewing object 39 and desires to set the positioning of the embroidery pattern in relation to the sewing object 39. It is assumed that the embroidery frame 84, which is holding the sewing object 39 onto which a reference marker has been created, has been mounted on the X carriage 22 when the start command is input. The reference marker is a marker that is created on the sewing object 39 and that indicates a position to which a reference point of the embroidery pattern is to be set in relation to the sewing object 39 and an angle to which an angle of the embroidery pattern is to be set. The reference point of the embroidery pattern is a point for specifying the position of the embroidery pattern. The reference point of the embroidery pattern according to the present embodiment is the center point of the embroidery pattern. The center point of the embroidery pattern may be, for example, the intersection of the two diagonals of the smallest rectangle into which the embroidery pattern will fit and that has sides parallel to the X axis and sides parallel to the Y axis. The reference marker according to the present embodiment is an x-shaped marker in which two lines intersect at right angles. The position of the intersection point of the two lines on the sewing object 39 indicates the position where the center point of the embroidery pattern will be set in relation to the sewing object 39. The angle of the two lines of the x-shaped marker, in relation to the sewing object 39, indicates the angle of the embroidery pattern will be set in relation to the sewing object 39. The user, using an air-soluble marker or the like, may draw the x-shaped marker in a portion of the sewing object 39 that is within the sewing area 86. It is assumed that the embroidery frame 84 is positioned at the initial position when the start command is input.

Figure 7:
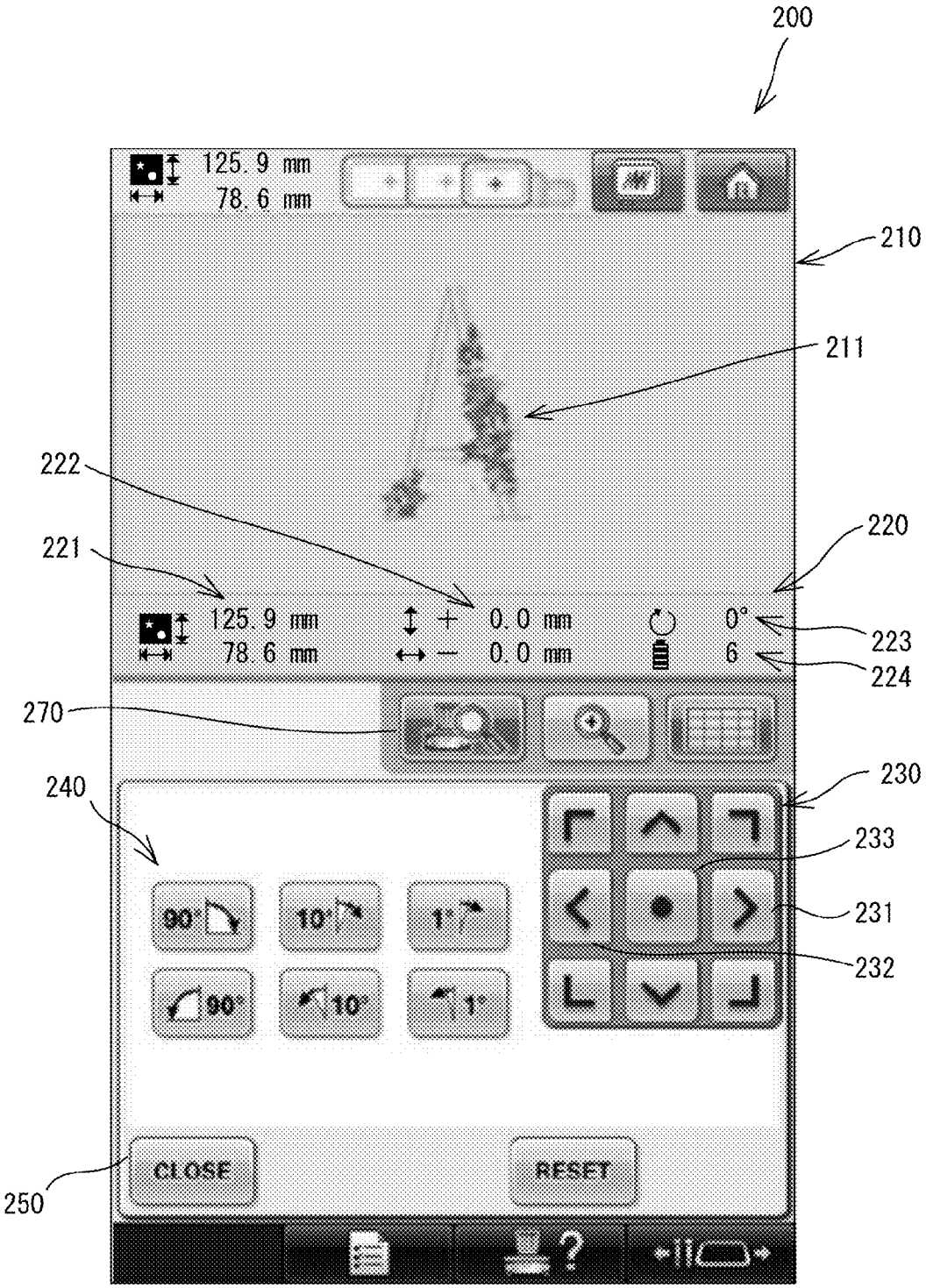
FIG. 7 is an explanatory figure of a screen 200 that is displayed on an liquid crystal display 7 in a case where an embroidery pattern 211 has been selected.

A screen 200 for inputting the start command will be explained with reference to FIG. 7. The start command is input when a camera image display button 270 is selected. The camera image display button 270 is displayed on the screen 200. The screen 200 is used for setting the position of the embroidery pattern after the embroidery pattern has been selected. An image that includes a pattern display area 210, an information display area 220, a group of positioning keys 230, a group of rotation keys 240, a close button 250, and the camera image display button 270 is displayed on the screen 200. An embroidery pattern 211 that has been selected is displayed in the pattern display area 210. The embroidery pattern 211 is a decorative pattern of the letter "A". Information that pertains to the embroidery pattern 211 is displayed in the information display area 220. Specifically, the information including a size 221, distances 222, an angle of rotation 223, and a number of color changes 224 are displayed in the information display area 220. The size 221 indicates the size of the embroidery pattern 211, which is expressed in the form of the length of the embroidery pattern 211 in the Y axis direction (the upper line in FIG. 7) and the length of the embroidery pattern 211 in the X axis direction (the lower line in FIG. 7). As shown in FIG. 7, the size of the embroidery pattern 211 is expressed as a length of 125.9 millimeters in the Y axis direction and a length of 78.6 millimeters in the X axis direction. The size of the embroidery pattern 211 is greater than the image capture area of the image sensor 151.

In a case where the set position of the center point of the embroidery pattern 211 has been moved, the distances 222 indicate the distance that the center point of the embroidery pattern 211 has been moved in the Y axis direction (the upper line in FIG. 7) and the distance that the center point has been moved in the X axis direction (the lower line in FIG. 7), in relation to the center point of the sewing area 86. The angle of rotation 223 indicates the angle of rotation in relation to the initial position of the embroidery pattern 211. A clockwise rotation in relation to the initial position of the embroidery pattern 211 is expressed as a positive rotation. The number of color changes 224 indicates the number of times that the thread must be replaced when the embroidery pattern 211 is sewn.

The group of positioning keys 230 are keys for issuing commands to move the embroidery pattern 211. The group of positioning keys 230 includes eight types of move keys and a center key 233. The eight types of move keys include a move right key 231 and a move left key 232. The respective move directions of the eight types of move keys have been set differently. The center key 233 is used for returning the center point of the embroidery pattern 211 to the center point of the sewing area 86. The amounts of movement of the embroidery pattern 211 ($\Delta Mx$, $\Delta My$) are specified according to the type of move key that has been selected and the amount that the move key has been operated. The amount that the move key has been operated includes the number of times that the move key has been operated and the length of time that the move key has been operated continuously. The group of rotation keys 240 is used for issuing a command that sets the angle of rotation $\phi$ of the embroidery pattern 211 in relation to the sewing object 39. The group of rotation keys 240 includes a plurality of keys for which the directions of rotation and the angles of rotation have been set differently. In the present embodiment, the embroidery pattern 211 is rotated around the center point of the embroidery pattern 211. The angle of rotation $\phi$ of the embroidery pattern 211 is specified in terms of the types of the six keys that the group of rotation keys 240 includes. The close button 250 is used for inputting a terminate command. The terminate command is input in order to terminate the main processing.

As shown in FIG. 6, in the main processing, first, the embroidery data for sewing the embroidery pattern 211 are acquired, and the acquired embroidery data are stored in the RAM 143 (Step S10). Specifically, the embroidery data for sewing the embroidery pattern 211 shown in FIG. 7 may be acquired from the ROM 142, for example.

Next, the image sensor 151 is moved to the image capture position (Step S20). Specifically, first, a control signal is output to the drive circuit 123 (refer to FIG. 5), and the needle bar case 21 is moved to a position where the rightmost of the engaging rollers 42 engages with the helical cam 48. The moving of the needle bar case 21 positions the image sensor 151 directly above the needle hole 36. Next, the image sensor 151 is started (Step S30). Specifically, the image sensor 151 starts processing that outputs captured image data to the control portion 140. The captured image data are data that describe the captured image. The captured image shows the sewing object 39 that is positioned between the needle bar 31 and the needle plate 16. In the present embodiment in particular, an image of the sewing object 39 that is held by the embroidery frame 84 is captured. The sewing object 39 that is held by the embroidery frame 84 is positioned between the needle bar 31 and the needle plate 16.

Next a determination is made as to whether a position setting command has been acquired (Step S40). The setting command may be input by the user. The setting command is a command for setting at least one of the reference point position and the angle of the embroidery pattern 211 in relation to the sewing object 39. In the present embodiment, the setting command includes two types of commands, the position setting command and an angle setting command. The position setting command is a command for setting the center point position of the embroidery pattern 211 in relation to the sewing object 39. The angle setting command is a command for setting the angle of the embroidery pattern 211 in relation to the sewing object 39. In the present embodiment, the CPU 341 acquires, as the position setting command, data that are output from the touch panel 8 when one of the move keys is selected. The data that are acquired as the position setting command describe the amount of movement ($\Delta Mx$, $\Delta My$) of the embroidery pattern 211 in the X axis direction and the Y axis direction. The acquired position setting command causes the center point of the embroidery pattern 211 to be set in the position to which the center point is moved ($\Delta Mx$, $\Delta My$) from the center point position of the embroidery pattern 211 at the time that the position setting command was input. If the position setting command has been acquired (YES at Step S40), the embroidery frame 84 is moved in accordance with the acquired position setting command (Step S50).

Specifically, in the first embodiment, the embroidery frame 84 is positioned in accordance with the position setting command such that the center point position of the embroidery pattern 211 that is designated by the position setting command is located close to the center of an area that is within the image capture area of the image sensor 151 and that is used for creating a composite image. The direction of movement of the position of the embroidery pattern 211 that is designated by the position setting command is the opposite of the direction of movement of the embroidery frame 84. For example, in a case where the acquired position setting command is a command for moving the embroidery pattern 211 to the right in relation to the sewing object 39, the CPU 141 causes the embroidery frame 84 to be moved to the left in the processing at Step S50. Specifically, control signals are output to the drive circuits 131, 133, and the embroidery frame 84 is moved in accordance with the position setting command. In conjunction with the movement of the embroidery frame 84, the relative position of the sewing object 39 is changed in relation to the image capture area of the image sensor 151. In the processing at Step S50, the position setting command is stored in the RAM 143, and the distances 222 in the information display area 220 are updated in accordance with the position setting command.

If the position setting command has not been acquired (NO at Step S40), as well as after the embroidery frame 84 has been moved (Step S50), a determination is made as to whether the angle setting command has been acquired (Step S60). Specifically, the CPU 141 acquires, as the angle setting command, from among data that have been output from the touch panel 8, data that describe the angle of rotation $\phi$ of the embroidery pattern 211. The data that describe the angle of rotation $\phi$ of the embroidery pattern 211 are output when the one of the keys in the group of rotation keys 240 is selected. The acquired angle setting command is a command for setting the angle of the embroidery pattern 211 such that the embroidery pattern 211 is rotated by the angle of rotation $\phi$ from the angle of the embroidery pattern 211 at the time that the angle setting command was input. If the angle setting command has been acquired (YES at Step S60), the acquired angle setting command is stored in the RAM 143 (Step S70). The angle setting command stored in the RAM 143 is referenced in display processing that will be described below. If the angle setting command has not been acquired (NO at Step S60), as well as after the acquired angle setting command has been stored (Step S70), the display processing is performed (Step S80). In the display processing, the center point position and the angle of the embroidery pattern 211 are displayed on the LCD 7.

Figure 8:
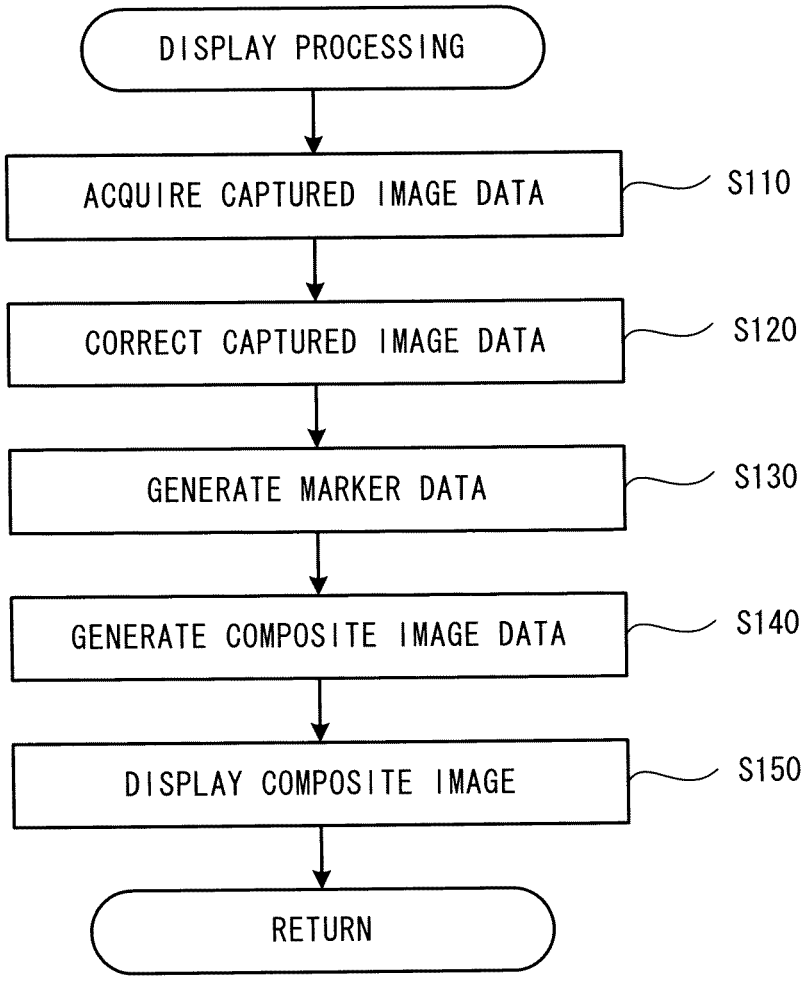
FIG. 8 is a flowchart of display processing that is performed in the main processing in FIG. 6.

The display processing will be explained with reference to FIG. 8. As shown in FIG. 8, in the display processing, first, data that are output from the image sensor 151 are acquired as the captured image data, and the acquired captured image data are stored in the RAM 143 (Step S110). Next, the captured image data that were acquired in the processing at Step S110 are corrected, and the corrected captured image data are stored in the RAM 143 (Step S120). Specifically, the captured image data that were acquired in the processing at Step S110 are corrected such that the captured image data become a captured image data that would be obtained in a case where the image sensor 151 is disposed in an ideal state. In the present embodiment, the ideal state is a state in which the image sensor 151 is positioned directly above the sewing object 39 and the XY plane in a camera coordinate system is parallel to the XY plane in the embroidery coordinate system 100. The camera coordinate system is the coordinate system for the image sensor 151. The image sensor 151 may not disposed in the ideal state due to factors that include a mounting error and a structural error of the image sensor 151. In the processing at Step S120, the captured image data that have been influenced by these sorts of factors are corrected.

The correcting in the processing at Step S120 may be performed based on a known method. For example, Japanese Laid-Open Patent Publication No. 2009-172119 discloses a method of computing data that describe a viewpoint-changed image, the relevant portions of which are incorporated by reference. The captured image data may be corrected in accordance with the method of computing data that describe the viewpoint-changed image, as hereinafter briefly explained. Image coordinates for the captured image are converted into three-dimensional coordinates in the camera coordinate system, using the internal parameters for the image sensor 151. Next, the three-dimensional coordinates in the camera coordinate system are converted into three-dimensional coordinates Mw (Xw, Yw, 0) in the world coordinate system, using the external parameters for the image sensor 151. As explained above, in the present embodiment, the coordinate Zw for the upper surface of the sewing object 39 is zero.

Next, the three-dimensional coordinates in the world coordinate system are converted to coordinates in the post-correction camera coordinate system (the coordinate system for the viewpoint-changed image). Among the external parameters for converting from the three-dimensional coordinates in the world coordinate system to the coordinates in the post-correction camera coordinate system, a rotation parameter $R_2$ is a 3-by-3 unit matrix, and a translation parameter $t_2$ is expressed as $(0, 0, t_{13})^T$. $(0, 0, t_{13})$ is a transposed matrix of $(0, 0, t_{13})$. $R_2$ and $t_2$ are stored in the EEPROM 144. Next, the three-dimensional coordinates in the post-correction camera coordinate system are converted into image coordinates for the post-correction captured image (the viewpoint-changed image), using the internal parameters for the image sensor 151. Coordinates Me (Xe, Ye) for the center point of the embroidery pattern 211 that are expressed in the embroidery coordinate system 100 (refer to FIG. 4) are defined by the equation (Xe, Ye)=(Xw+Xf, Yw+Yf). (Xf, Yf) express the amounts of movement in the X axis direction and the Y axis direction, respectively, in relation to the initial position of the embroidery frame 84.

Figure 9:
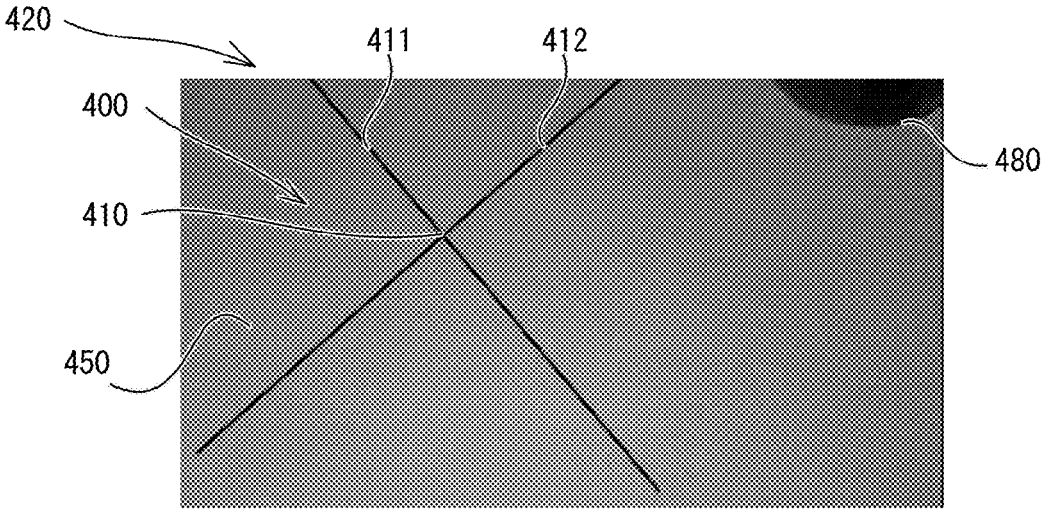
FIG. 9 is an explanatory figure of a captured image 420 that is displayed in accordance with corrected captured image data.

In the present embodiment, composite image data are generated based on, of the post-correction captured image data, data for a portion that describes a rectangular area with a length of 55 millimeters in the left-right direction and a length of 35 millimeters in the front-rear direction. A specific example is considered in which a captured image 420 shown in FIG. 9 is described by the captured image data that were corrected in the processing at Step S120. As shown in FIG. 9, a sewing object 450, a reference marker 400, and a member 480 are included in the captured image 420. The sewing object 450 indicates the portion of the sewing object 39 that is within the image capture area of the image sensor 151. The reference marker 400 is an x-shaped marker in which line segments 411 and 412 intersect at right angles at an intersection point 410. The member 480 is a member that the threading mechanism 126 (refer to FIG. 5) includes.

Figure 10:
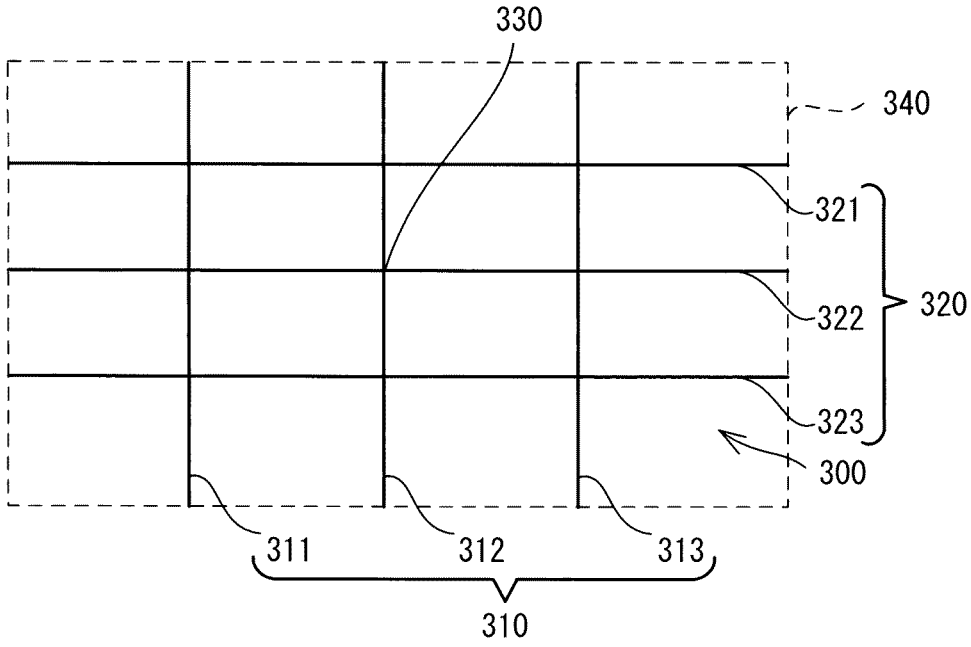
FIG. 10 is an explanatory figure of a positioning of a first marker 300 (angle of rotation $\phi$=zero degrees) in relation to a rectangle 340 that depicts a size and a shape of a captured image.
Figure 11:
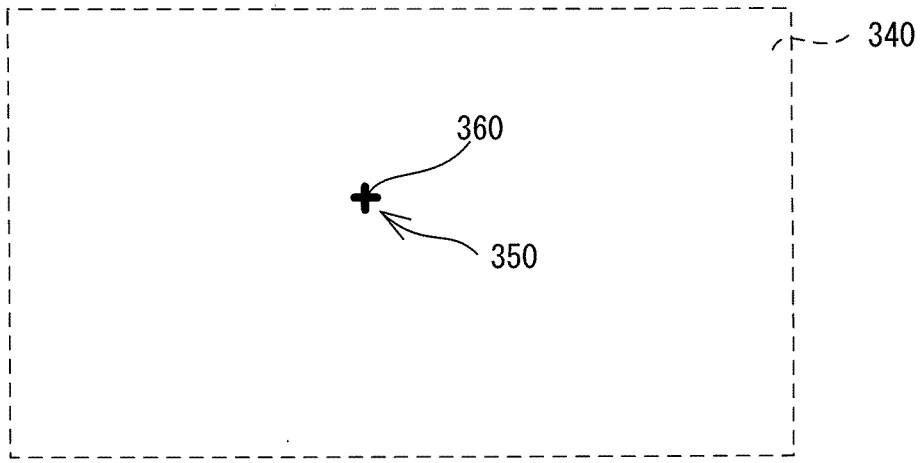
FIG. 11 is an explanatory figure of a positioning of a second marker 350 in relation to the rectangle 340.

Next, marker data are generated, and the generated marker data are stored in the RAM 143 (Step S130). The marker data are data that describe a setting marker 380 (refer to FIG. 12). The setting marker 380 is a marker that indicates the settings of the position of the reference point (the center point) of the embroidery pattern 211 and the angle of the embroidery pattern 211 in relation to the sewing object 39. The setting marker 380 is a marker in which a first marker 300 shown in FIG. 10 and a second marker 350 shown in FIG. 11 are combined. In FIGS. 10 and 11, a rectangle 340 describes the size and the shape of the captured image 420. As shown in FIGS. 10 and 11, the first marker 300 and the second marker 350 are contained within the rectangle 340. The first marker 300 shown in FIG. 10 indicates the center point position and the angle of the embroidery pattern 211 in relation to the sewing object 39. The first marker 300 shown in FIG. 10 indicates a case in which the angle of rotation of the embroidery pattern 211 in relation to the sewing object 39 is zero degrees. As shown in FIG. 10, the first marker 300 includes line segment groups 310 and 320. The line segment group 310 includes three line segments 311 to 313. The line segment 312 passes close to the center point of the rectangle 340. The line segments 311 to 313 are disposed at equal intervals. In the case where the angle of rotation of the embroidery pattern 211 in relation to the sewing object 39 is zero degrees, the line segments 311 to 313 extend in a direction that is parallel to the Y axis in the embroidery coordinate system. The line segment group 320 includes three line segments 321 to 323 that intersect the line segments 311 to 313. The line segment 322 passes close to the center point of the rectangle 340. The line segments 321 to 323 are disposed at equal intervals. The intervals between the line segments 311 to 313 are wider than the intervals between the line segments 321 to 323. In the case where the angle of rotation of the embroidery pattern 211 in relation to the sewing object 39 is zero degrees, the line segments 321 to 323 extend in a direction that is parallel to the X axis in the embroidery coordinate system. The line segment groups 310 and 320 are distinguished based on the difference in the intervals between the line segments.

An intersection point 330 of the line segments 312 and 322 indicates the center point position of the embroidery pattern 211 in relation to the sewing object 39. The respective slopes of the line segment groups 310 and 320 in relation to the embroidery coordinate system indicate the angle of the embroidery pattern 211 in relation to the sewing object 39. In the present embodiment, the position of the intersection point 330 is fixed in relation to the rectangle 340. The first marker 300 is rotated around the intersection point 330 in accordance with the angle setting command that is acquired in the processing at Step S60 shown in FIG. 6. In a case where the first marker 300 is rotated, the ends of the line segments in the line segment groups 310 and 320 are set such that each of the line segments extends from one edge to another edge of the rectangle 340. In the present embodiment, the slope of the first marker 300 in relation to the rectangle 340 is the same in a case where the angle of rotation of the embroidery pattern 211 is P degrees as that in a case where the angle of rotation of the embroidery pattern 211 is P+180 degrees. The case where the angle of rotation of the embroidery pattern 211 is P degrees and the case where the angle of rotation of the embroidery pattern 211 is P+180 degrees are distinguished from one another based on the angle of rotation 223 in the information display area 220. The color of the first marker 300 is set to gray.

The second marker 350 shown in FIG. 11 indicates the center point position of the embroidery pattern 211 in relation to the sewing object 39. The second marker 350 is a black, plus-shaped marker with a green border. A plus-shaped intersection point 360 is superimposed on the intersection point 330 of the first marker 300. The second marker 350 is unrelated to the angle setting command that is acquired in the processing at Step S60, so the second marker 350 is not rotated. In the processing at Step S130, data that describe the positions of the first marker 300 and the second marker 350 in relation to the sewing object 39 in the area that is indicated by the rectangle 340 are generated as the marker data. The first marker 300 is rotated in accordance with the angle setting command that was stored in the processing at Step S70 shown in FIG. 6, and the lengths of the line segments of the first marker 300 are updated. In the specific example, it is assumed that marker data that describe the first marker 300 shown in FIG. 10 and the second marker 350 shown in FIG. 11 are generated.

Next, the composite image data are generated based on the captured image data that were corrected in the processing at Step S120 and the marker data that were generated in the processing at Step S130. The generated composite image data are stored in the RAM 143 (Step S140). The composite image data are data that describe the composite image that is an image in which the setting marker 380 is superimposed on the captured image 420 in the position that is indicated by the marker data. In the specific example, the composite image is an image in which the first marker 300 shown in FIG. 10 and the second marker 350 shown in FIG. 11 are superimposed on the captured image 420 shown in FIG. 9, based on the positioning of the embroidery pattern 211 in relation to the sewing object 39 in the area that is indicated by the rectangle 340. Next, a control signal is output to the drive circuit 135, and the composite image is displayed on the LCD 7 based on the generated composite image data (Step S150). In the specific example, a screen 201 shown in FIG. 12 is displayed on the LCD 7.

Figure 12:
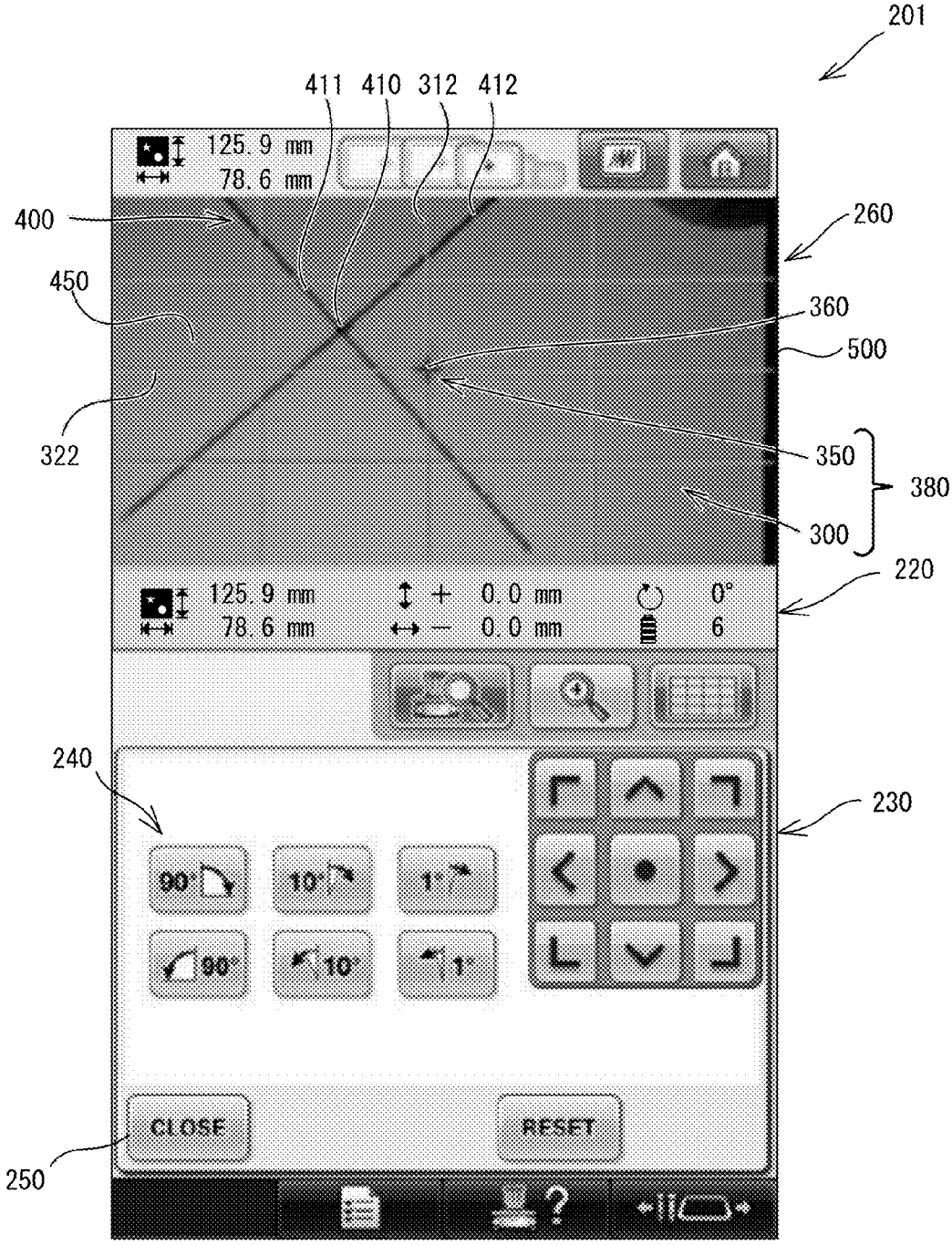
FIG. 12 is an explanatory figure of a screen 201 that is displayed on the liquid crystal display 7 and that contains a composite image 500.

As shown in FIG. 12, on the screen 201, a composite image display area 260 is displayed instead of the pattern display area 210 of the screen 200 that is shown in FIG. 7. A composite image 500 that is described by the composite image data that were generated in the processing at Step S140 is displayed in the composite image display area 260. The composite image 500 shows the sewing object 450, the reference marker 400, and the setting marker 380 (the first marker 300 and the second marker 350). In the composite image 500, the intersection point 410 of the reference marker 400 does not coincide with the intersection point 360 of the second marker 350. In the composite image 500, the line segments 411 and 412 of the reference marker 400 are not aligned with the line segments 322 and 312 of the first marker 300. The composite image 500 shows that the center point position and the angle of the embroidery pattern 211 have not been set as indicated by the reference marker 400. The display processing is terminated, and the processing returns to the main processing.

In the main processing shown in FIG. 6, after the display processing is performed (Step S80), the embroidery data stored in the RAM 143 are corrected and updated (Step S90). In the processing at Step S90, the embroidery data stored in the RAM 143 are corrected based on the settings of the position of the reference point (the center point) of the embroidery pattern 211 and the angle of the embroidery pattern 211 in relation to the sewing object 39. Specifically, the embroidery data are corrected based on the amounts of movement ($\Delta Mx$, $\Delta My$) of the center point of the embroidery pattern 211 in the X axis direction and the Y axis direction and on the angle of rotation $\phi$ of the embroidery pattern 211. The amounts of movement ($\Delta Mx$, $\Delta My$) of the embroidery pattern 211 in the X axis direction and the Y axis direction are set based on the position setting command. The angle of rotation $\phi$ of the embroidery pattern 211 is set based on the angle setting command. In a case where the embroidery data are data that are expressed in the form (x, y), the post-correction embroidery data (x', y') are computed based on the equation $(x', y')=(x \cos(-\phi)\ y \sin(-\phi)\ x \sin(-\phi)\ y \cos(-\phi)+\Delta My)$. Thus the embroidery data stored in the RAM 143 are corrected such that the embroidery pattern 211 will be sewn in the position that is indicated by the setting marker 380 in the composite image 500.

Next a determination is made as to whether a terminate command has been input (Step S100). In the present embodiment, the CPU 141 acquires, as the terminate command, data that is output from the touch panel 8 when the close button 250 are selected. If the terminate command has been acquired (YES at Step S100), the main processing is terminated. If the terminate command has not been acquired (NO at Step S100), the processing returns to Step S40.

Figure 13:
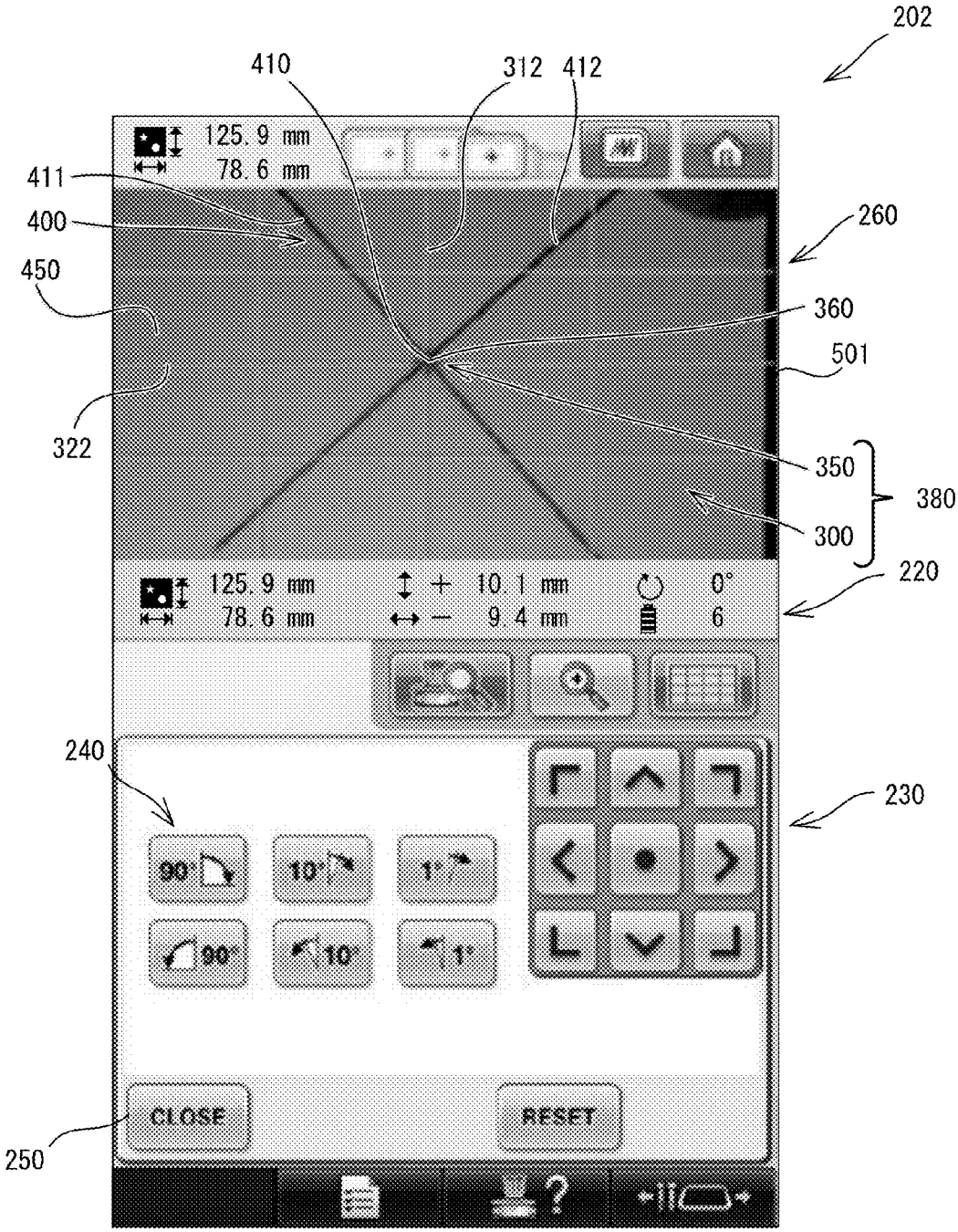
FIG. 13 is an explanatory figure of a screen 202 that is displayed on the liquid crystal display 7 and that contains a composite image 501.

In the specific example, a case is considered in which the screen shown in FIG. 12 is displayed. In this case, the user may input the position setting command (YES at Step S40) while checking the composite image 500, such that the displayed position of the intersection point 410 and the displayed position of the intersection point 360 in the second marker 350 are brought into alignment. In a case where the embroidery frame 84 is moved 10.1 millimeters in the negative Y axis direction and 9.4 millimeters in the positive X axis direction as a result of the inputting of the position setting command, a screen 202 shown in FIG. 13 is displayed on the LCD 7 (Step S150 in FIG. 8). A composite image 501 is displayed in the composite image display area 260 of the screen 202. The composite image 501 shows the sewing object 450, the reference marker 400, and the setting marker 380 (the first marker 300 and the second marker 350). In the composite image 501, the intersection point 410 of the reference marker 400 is aligned with the intersection point 360 of the second marker 350. However, in the composite image 501, the line segments 411 and 412 of the reference marker 400 are not congruent with the line segments 322 and 312 of the first marker 300. In other words, the composite image 501 shows a state in which the center point position of the embroidery pattern 211 has been set to the position that is indicated by the reference marker 400 but the angle of the embroidery pattern 211 has not been set to the angle that is indicated by the reference marker 400.

Figure 14:
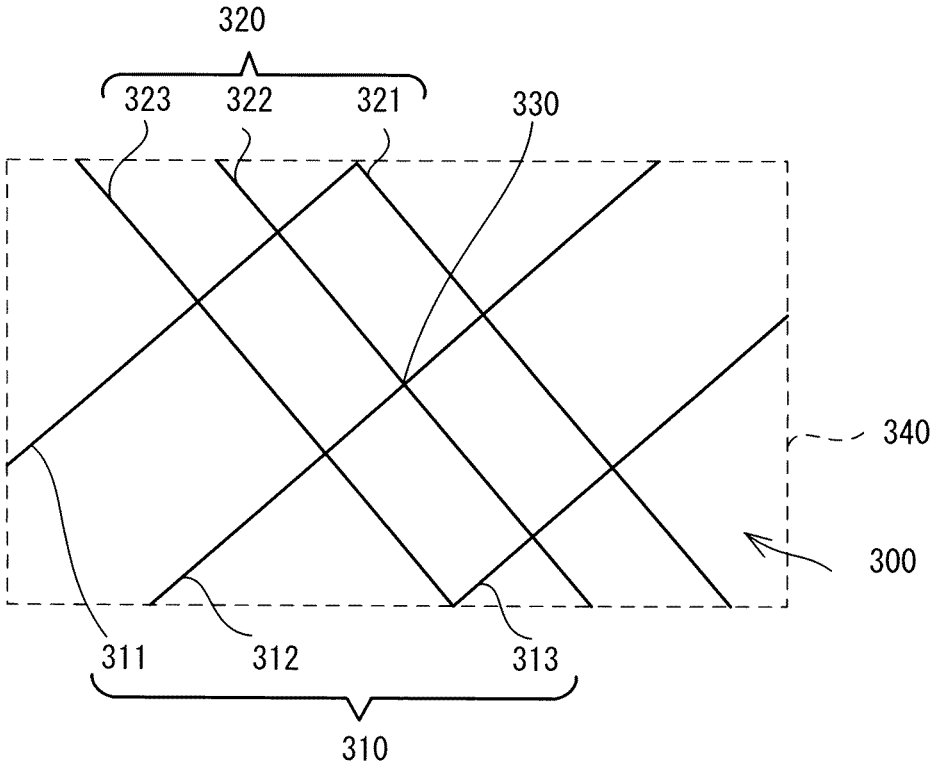
FIG. 14 is an explanatory figure of a positioning of the first marker 300 (angle of rotation ϕ=fifty degrees) in relation to the rectangle 340.

In the specific example, in the state in which the screen 202 shown in FIG. 13 is being displayed, the user may input the angle setting command (YES at Step S60) while checking the composite image 501, such that the line segments 411 and 412 of the reference marker 400 become congruent with the line segments 322 and 312 of the first marker 300 at the desired angle of rotation. In a case where the embroidery pattern 211 has been rotated fifty degrees around the center point of the embroidery pattern 211 as a result of the inputting of the angle setting command, data that describe the first marker 300 shown in FIG. 14 and the second marker 350 shown in FIG. 11 are generated as the marker data in the processing at Step S130 in FIG. 8. The first marker 300 shown in FIG. 14 is generated by rotating the first marker 300 shown in FIG. 10 fifty degrees around the intersection point 330 and by changing the lengths of the line segments 311 to 313 and 321 to 323 such that each of the line segments extends from one edge to another edge of the rectangle 340.

Figure 15:
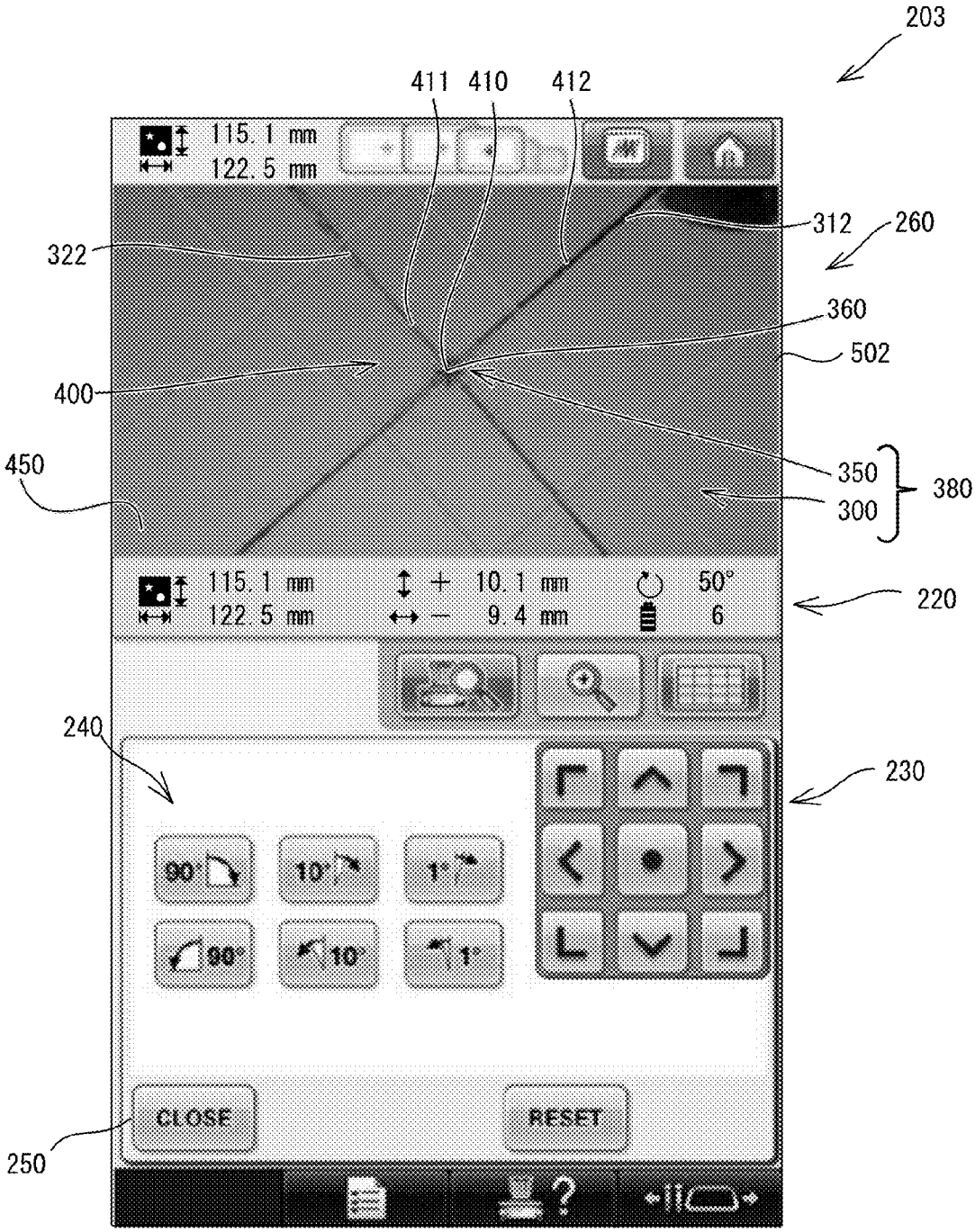
FIG. 15 is an explanatory figure of a screen 203 that is displayed on the liquid crystal display 7 and that contains a composite image 502.

In the processing at Step S150, a screen 203 shown in FIG. 15 is displayed on the LCD 7. A composite image 502 is displayed in a composite image display area 260 of the screen 203. The composite image 502 shows the sewing object 450, the reference marker 400, and the setting marker 380 (the first marker 300 and the second marker 350). In the composite image 502, the intersection point 410 of the reference marker 400 is aligned with the intersection point 360 of the second marker 350. In the composite image 502, the line segments 411 and 412 of the reference marker 400 are congruent with the line segments 322 and 312 of the first marker 300. In other words, the composite image 502 shows that the center point position and the angle of the embroidery pattern 211 have been set as indicated by the reference marker 400. The user may use the composite image 502 to confirm that the center point position and the angle of the embroidery pattern 211 have been set as indicated by the reference marker 400. Thereafter, the user may input the terminate command (YES at Step S100).

According to the sewing machine 1 according to the first embodiment, the user may check the positioning of the embroidery pattern 211 in relation to the sewing object 39 by looking at the setting marker 380 in the composite image, even in a case where the size of the embroidery pattern 211 exceeds the image capture area of the image sensor 151. Before the main processing is started, the x-shaped reference marker 400 is created on the sewing object 39. Therefore, based on the reference marker 400 and the setting marker 380 that are shown in the composite image, the user can easily check whether the positioning of the embroidery pattern 211 has been set as the user desires.

The sewing machine 1 may modify the area of the sewing object 39 that is shown in the composite image in accordance with the position setting command that has been input. Therefore, after the position of the embroidery pattern 211 has been set according to the position setting command, the sewing machine 1 may automatically move the embroidery frame 84 such that the position of the reference point (the center point) of the embroidery pattern 211 is within the image capture area of the image sensor 151. The sewing machine 1 may modify the angle of the first marker 300 in relation to the sewing object 39 shown in the composite image in accordance with the angle setting command that has been input. Therefore, after the positioning of the embroidery pattern 211 has been set in accordance with at least one of the position setting command and the angle setting command, the user may use the composite image to easily check the positioning of the embroidery pattern 211 in relation to the sewing object 39. Furthermore, in the present embodiment, the embroidery data are corrected in the processing at Step S90 based on the position setting command acquired in the processing at Step S40 and on the angle setting command acquired in the processing at Step S60. Therefore, the user may set the positioning of the embroidery pattern 211 in relation to the sewing object 39 after using the setting marker 380 in the composite image to check whether the embroidery pattern 211 has been positioned as the user desires. In accordance with the corrected embroidery data, the sewing machine 1 may sew the embroidery pattern 211 on the sewing object 39 in the position that the user desires.

According to the sewing machine 1 according to the first embodiment, by looking at the composite image, the user may check both of the reference point position and the angle of the embroidery pattern in relation to the sewing object 39, regardless of the size of the embroidery pattern in relation to the image capture area of the image sensor 151.

Figure 16:
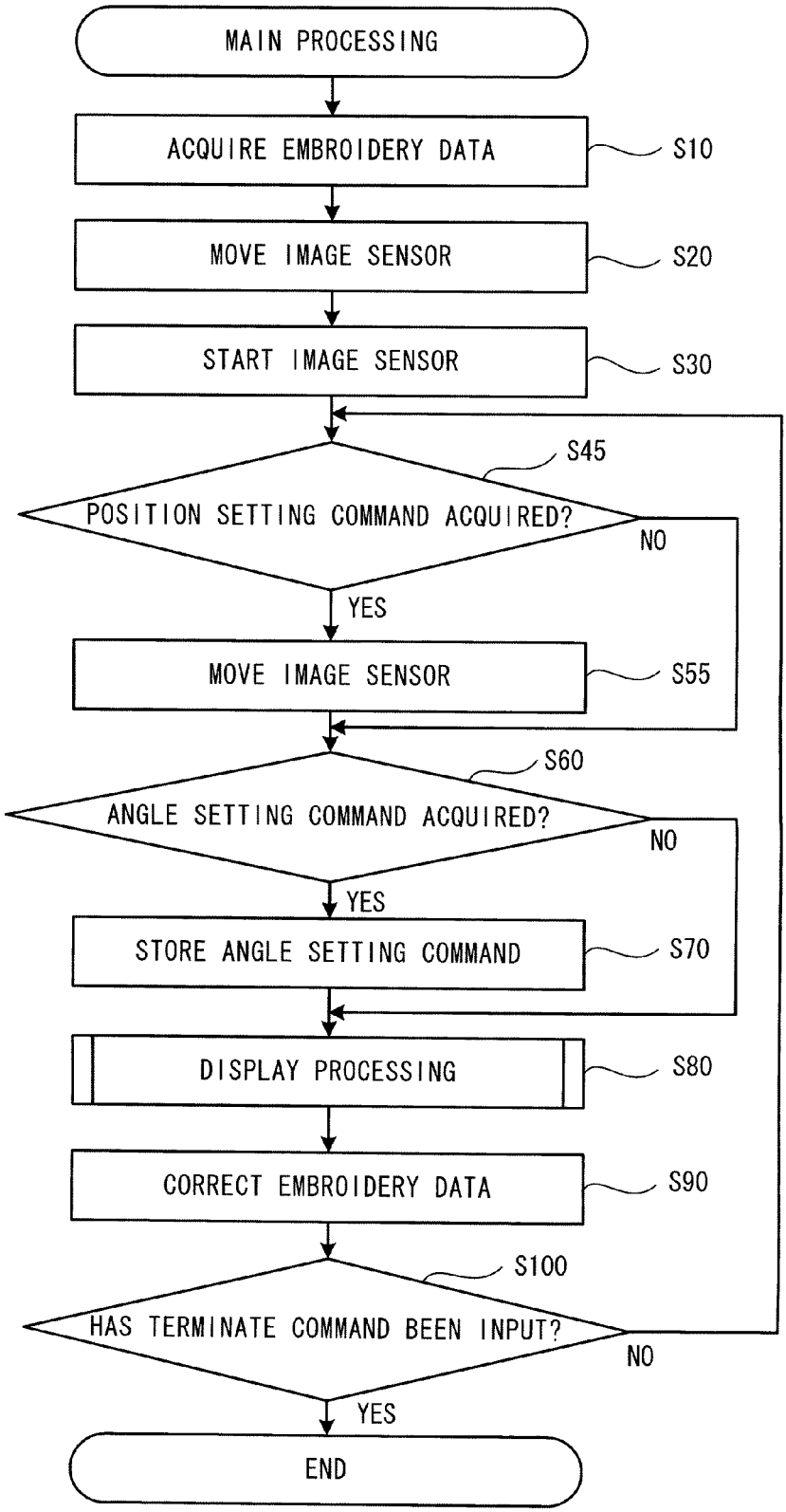
FIG. 16 is a flowchart of main processing in a second embodiment.

The main processing according to the second embodiment will be explained with reference to FIG. 16. The CPU 141 performs the main processing shown in FIG. 16 in accordance with the main program stored in the ROM 142. In FIG. 16, the same step numbers are assigned to steps where the processing performed is the same as in the main processing according to the first embodiment, as shown in FIG. 6. The main processing according to the second embodiment differs from the main processing according to the first embodiment, as shown in FIG. 6, in that processing at Steps S45 and S55 is performed instead of the processing at Steps S40 and S50. Explanations will be omitted for the processing that is the same as in the first embodiment. Hereinafter, the processing at Steps S45 and S55, which are different from the first embodiment, will be explained.

In the processing at Step S45, a determination is made as to whether the position setting command has been input. In the second embodiment, it is possible to change the position of the embroidery pattern in the left-right direction in relation to the initial position of the embroidery pattern. The CPU 141 acquires, as the position setting command, data that are output from the touch panel 8 when one of the move right key 231, the move left key 232, and the center key 233 (refer to FIG. 7) is operated. The position setting command according to the second embodiment indicates the amount of movement ΔMx of the embroidery pattern. The amount of movement ΔMx of the embroidery pattern is set to a value that corresponds to the type of the key that has been operated and the amount that the key has been operated. If the position setting command has been acquired (YES at Step S45), the needle bar case 21 is moved to a position that corresponds to the acquired position setting command (Step S55). Specifically, in the second embodiment, the needle bar case 21 is moved in accordance with the position setting command such that the center point position of the embroidery pattern is located in the same position as in the processing at Step S50 in the main processing according to the first embodiment, as shown in FIG. 6. The direction of movement of the position of the embroidery pattern 211 that is specified by the position setting command is the same as the direction of movement of the needle bar case 21. Specifically, a control signal is output to the drive circuit 123 (refer to FIG. 5), and the needle bar case 21 is moved to a position where the engaging roller 42 that corresponds to the amount of movement ΔMx that is indicated by the position setting command engages with the helical cam 48. The image sensor 151 is moved in the left-right direction of the sewing machine 1 by the moving of the needle bar case 21. In conjunction with the moving of the image sensor 151, the relative position of the image capture area of the image sensor 151 is changed in relation to the sewing object 39. In the processing at Step S55, the distances 222 in the information display area 220 are updated in accordance with the position setting command.

With the sewing machine 1 according to the second embodiment, the user may modify the area of the sewing object 39 that is shown in the composite image by moving the image sensor 151. Therefore, after the image sensor 151 has been automatically moved such that the center point of the embroidery pattern 211 that is specified by the position setting command is within the image capture area of the image sensor 151, the user may check the positioning of the embroidery pattern 211 in relation to the sewing object 39.

Figure 17:
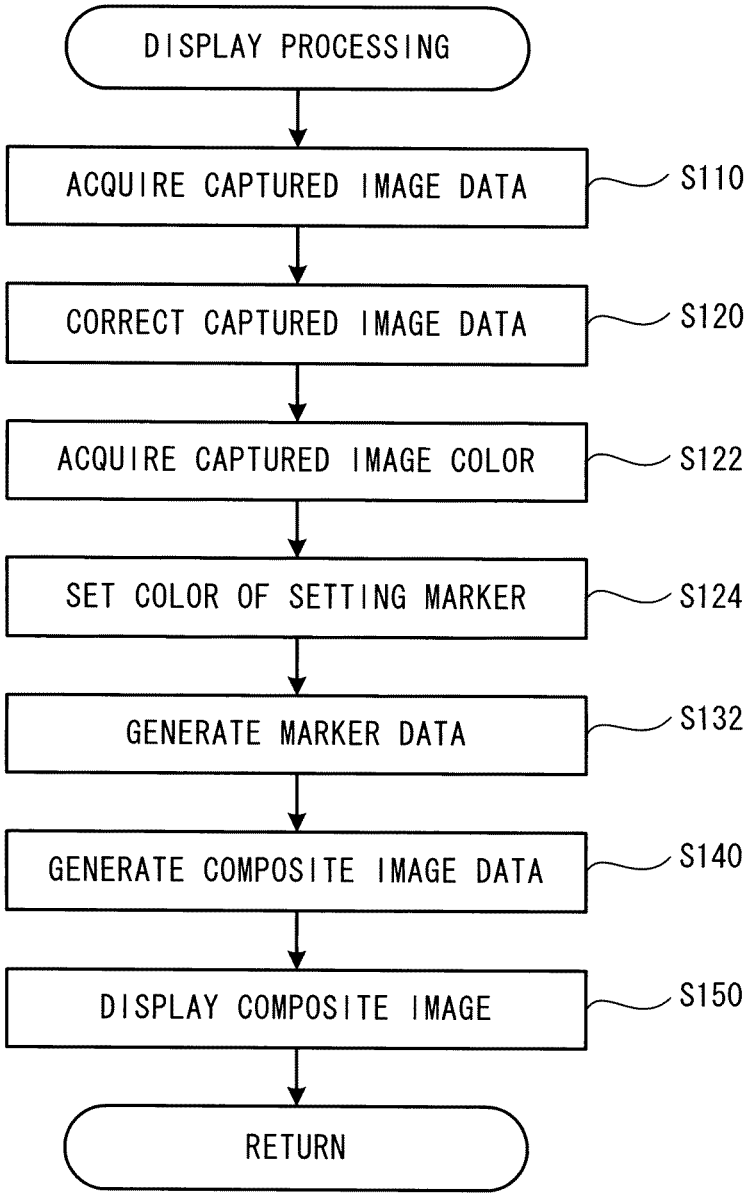
FIG. 17 is a flowchart of display processing in a third embodiment.

The main processing according to the third embodiment will be explained. The CPU 141 performs the main processing according to the third embodiment in accordance with the main program stored in the ROM 142. In the third embodiment, the display processing that is performed in the processing at Step S80 of the main processing according to the first embodiment, as shown in FIG. 6, is different from the display processing shown in FIG. 8. Hereinafter, the display processing according to the third embodiment will be explained with reference to FIG. 17. In FIG. 17, the same step numbers are assigned to steps where the processing that is performed is the same as in the display processing according to the first embodiment, as shown in FIG. 8. The display processing according to the third embodiment differs from the display processing according to the first embodiment, as shown in FIG. 8, in that processing at Steps S122, S124, and S132 is performed instead of the processing at Step S130. Explanations will be omitted for the processing that is the same as in the first embodiment. Hereinafter, the processing at Steps S122, S124, and S132, which are different from the first embodiment, will be explained.

In the processing at Step S122, a color of the captured image is acquired based on the captured image data that were corrected at Step S120. The acquired color of the captured image is stored in the RAM 143 (Step S122). For example, based on the captured image data that were corrected in the processing at Step S120, the average of the RGB values of the pixels that are contained in the captured image may be acquired as the color of the captured image. Next, a color of the setting marker 380 (the first marker 300 and the second marker 350) is set based on the acquired color of the captured image. The color of the setting marker 380 that has been set is stored in the RAM 143 (Step S124). Specifically, a color that is different from the color of the captured image that is acquired in the processing at Step S122 is set as the color of the setting marker 380. In the third embodiment, a complementary color of the color of the captured image is set as the color of the setting marker 380, taking into account the visibility of the setting marker 380 in relation to the sewing object 450. A known method may be used as appropriate for the method for computing the complementary color. For example, the RGB values of the complementary color may be defined as the difference between the RGB values of the color of the captured image and a gradation value 255 of the RGB values. For example, in a case where the RGB values of the color of the captured image are expressed as (R, G, B)=(160, 80, 30), the complementary color of the color of the captured image may be expressed as (R', G', B')=(95, 175, 225). In the processing at Step S132, the marker data are generated that describe the setting marker 380 (the first marker 300 and the second marker 350) of the color that was set in the processing at Step S124 (Step S132).

With the sewing machine 1 according to the third embodiment, a color that is different from the color of the sewing object 39 that is shown in the captured image is set as the color of the setting marker 380. In the third embodiment, a complementary color of the colors of the sewing object 39 is specifically set as the color of the setting marker 380. The color of the setting marker 380 in the composite image that is displayed in the processing at Step S150 in the main processing according to the third embodiment is the color that has been set in the processing at Step S124 and is different from the color of the captured image. Therefore, the user may easily recognize the setting marker 380 that is shown in the composite image.

The main processing according to a fourth embodiment will be explained with reference to FIG. 18. The CPU 141 performs the main processing shown in FIG. 18 in accordance with the main program stored in the ROM 142. The main processing according to the fourth embodiment may be started, for example, when the user inputs a start command using a panel operation. For example, the user may select the embroidery pattern 211 that will be sewn on the sewing object 39 and set the positioning of the embroidery pattern 211. Then, in the case where the user desires to check the positioning of the embroidery pattern 211 in relation to the sewing object 39 on the screen that is displayed on the LCD 7, the user may input the start command. The positioning of the embroidery pattern 211 in relation to the sewing object 39 may be set before the main processing is performed, for example, by operating at least one of the keys in the group of positioning keys 230 and the group of rotation keys 240 on the screen 200 that is displayed on the LCD 7, as shown in FIG. 7.

Figure 18:
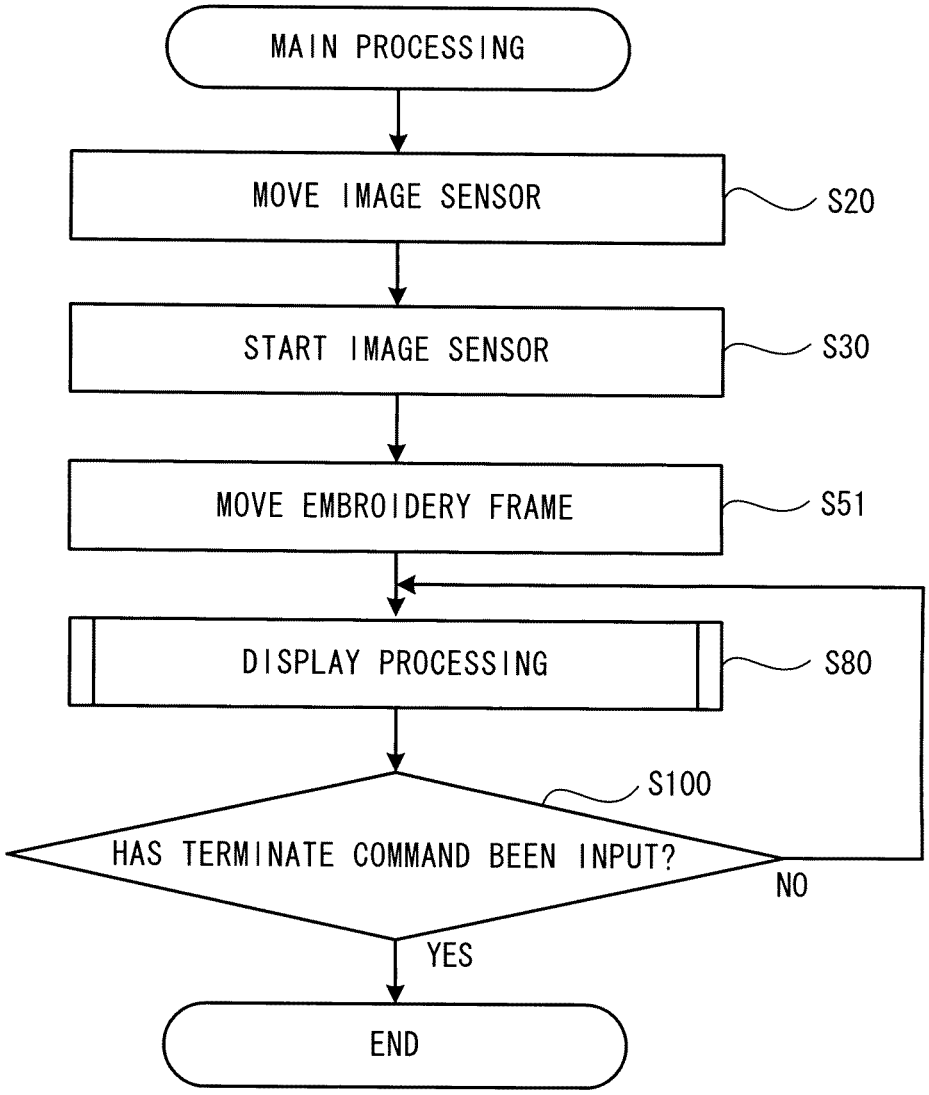
FIG. 18 is a flowchart of main processing in a fourth embodiment.

In FIG. 18, the same step numbers are assigned to steps where the processing that is performed is the same as in the main processing according to the first embodiment, as shown in FIG. 6. In the main processing according to the fourth embodiment, the processing that is performed at Steps S20, S30, S80, and S100 is the same as in the first embodiment. In the main processing according to the fourth embodiment, the processing that is performed at Step S51 is different from the first embodiment. Explanations will be omitted for the processing in the main processing according to the fourth embodiment differs that is the same as the processing in the first embodiment. In the processing at Step S51, the embroidery frame 84 is moved such that the center point position of the embroidery pattern 211 is positioned close to the center of the area, within the image capture area of the image sensor 151, which is used in creating the composite image. According to the sewing machine 1 according to the fourth embodiment, in a case where the selected embroidery pattern 211 will be sewn in the position that has been set, the user may check the position where the embroidery pattern 211 will be sewn by looking at the reference marker 400 and the setting marker 380 (the first marker 300 and the second marker 350) in the composite image. Therefore, by looking at the composite image and checking the position of the embroidery pattern 211, the user may prevent the sewing of the embroidery pattern 211 in a position where the user does not intend for the embroidery pattern 211 to be sewn.

The sewing machine of the present disclosure is not limited to the above embodiments that are described above, and various types of modifications may be made within the scope of the present disclosure. For example, modifications (A) to (F) below may be made as desired.

(A) The configuration of the sewing machine 1 can be modified as desired. For example, the type and the positioning of the image sensor 151 may be modified as desired. For example, the image sensor 151 may be an image capture element other than a CMOS image sensor, such as a CCD camera. The direction in which the embroidery frame moving mechanism 11 moves the X carriage 22 can be modified as desired. The embroidery frame moving mechanism 11 may be omitted. The sewing machine 1 may be a single-needle sewing machine instead of a multi-needle sewing machine. In a case where the present disclosure is applied to a multi-needle sewing machine, the number of needles that the multi-needle sewing machine include is not limited to six and may be any number that is greater than one. The sewing machine 1 may includes a dedicated mechanism for moving the image sensor 151.

(B) The main processing that is performed in the sewing machine 1 may be modified as necessary. For example, in the display processing in the above embodiments, the processing that corrects the captured image data may be modified as desired and may be omitted. The captured image data that are used for creating the composite image in the above embodiments may be data that describe the entire image capture area and may be data that describe a portion of the image capture area. In a case where the position setting command has been acquired, the center point position of the embroidery pattern within the composite image, which is indicated by the setting marker, may be changed in accordance with the position setting command. In the case where the position setting command has been acquired, both the needle bar case 21 and the embroidery frame 84 may be moved in accordance with the position setting command.

(C) The reference point of the embroidery pattern may be a point that represents the embroidery pattern. For example, instead of being the center point of the embroidery pattern, the reference point of the embroidery pattern may be one of the vertices of the smallest rectangle into which the embroidery pattern fits. In a case where the reference point of the embroidery pattern is the center point of the embroidery pattern, the method for setting the center point may be modified as desired. For example, the center of the smallest circle into which the embroidery pattern fits may be defined as the center point of the embroidery pattern. A plurality of types of reference points may be stored in advance in a storage device such as the EEPROM 144, and the reference point that is indicated by the setting marker may be designated from among the plurality of the types of reference points. Any point that the user designates may be defined as the reference point. In that case, it is possible for the user to make it more convenient to check the positioning of the embroidery pattern in relation to the sewing object by designating, as the reference point, the point where the user desires to check the positioning in relation to the sewing object. In the above embodiments, the angle of the embroidery pattern in relation to the sewing object is expressed as the angle of rotation around the center point of the embroidery pattern, in relation to the initial position of the embroidery pattern. As long as the angle of the embroidery pattern in relation to the sewing object can be specified, the reference for the angle of the embroidery pattern may be other than the initial position of the embroidery pattern. The center of rotation and the like may be modified as desired.

Figure 19:
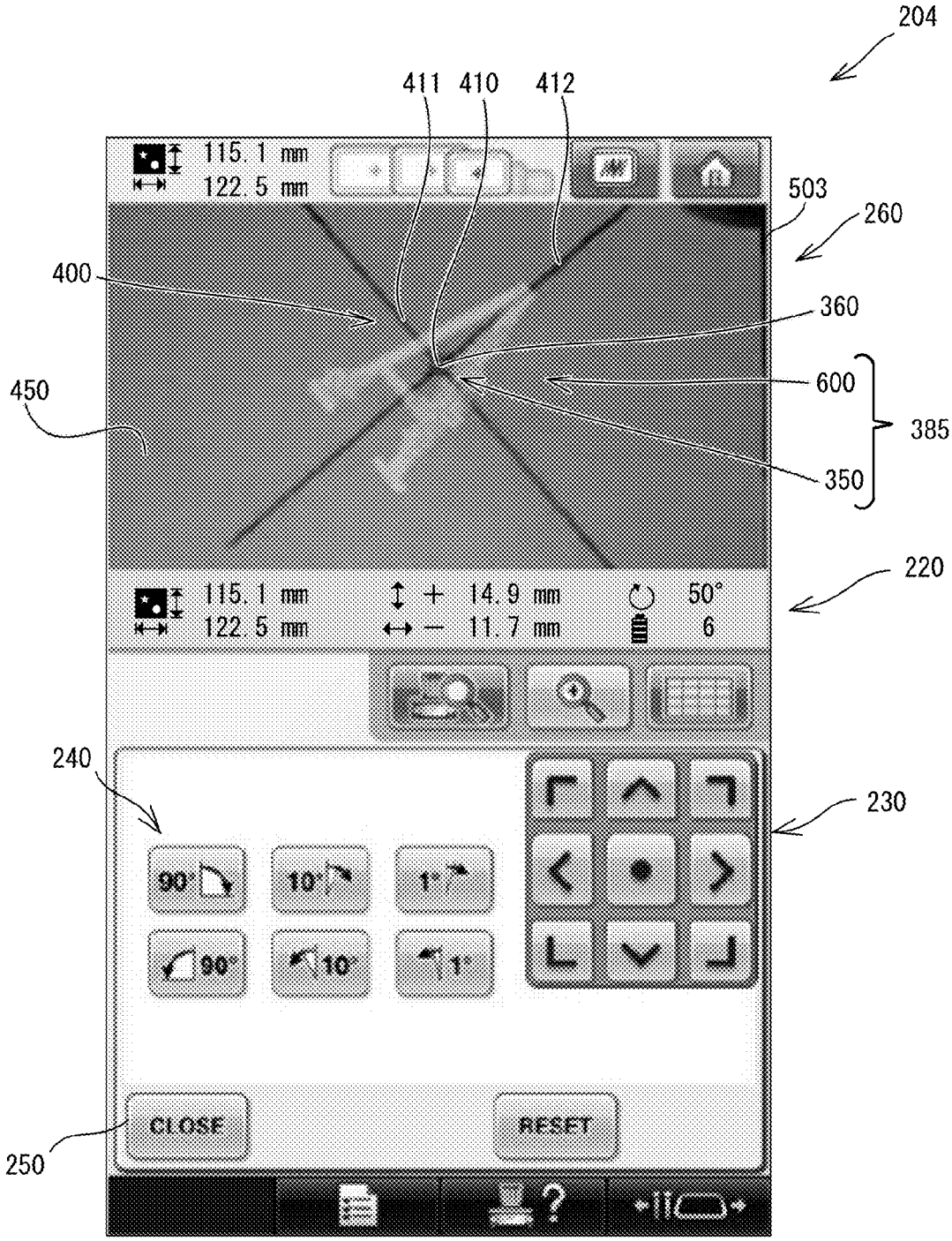
FIG. 19 is an explanatory figure of a composite image 503 that includes the second marker 350 and a third marker 600 of a modified example.

(D) The shape and the size of the setting marker may be modified as desired, as long as the setting marker fits within the composite image. For example, in the above embodiments, the marker in which the first marker 300 and the second marker 350 are combined is the setting marker. However, the reference point position of the embroidery pattern and the angle of the embroidery pattern in relation to the sewing object 39 may be described by one of the first marker 300 and the second marker 350. For example, a pattern such as an arrow or a star may be used as the setting marker. In a case where the arrow is used as the setting marker, the direction in which the arrow points, for example, may describe the angle of the embroidery pattern in relation to sewing object 39, and the tip of the arrow may describe the reference point position of the embroidery pattern in relation to the sewing object. For example, a pattern, such as a third marker 600 on a screen 204 shown in FIG. 19, which has been appropriately reduced such that the embroidery pattern 211 fits into the composite image display area 260 may be used as the setting marker. In that case, the user may easily determine how the embroidery pattern 211 will be sewn on the sewing object 39, based on a setting marker 385 (the second marker 350 and the third marker 600) that is contained within a composite image 503. A plurality of types of setting markers may be stored in advance in a storage device such as the EEPROM 144, and the setting marker that the user desires may be designated from among the plurality of the types of setting markers. The use of the reference marker may be omitted. The shape and the size of the reference marker may be modified as desired. It is acceptable for the user not to draw a specified marker as the reference marker on the sewing object. In a case where the sewing object has its own pattern, the pattern may be used as the reference marker.

(E) The color of the setting marker may be set based on the color of the captured image. The color of the setting marker may be a default color. In a case where the color of the setting marker is set based on the color of the captured image, the method for setting the color of the captured image may be modified as desired. For example, a mode value of the RGB values of the pixels that are contained in the captured image may be set as the color of the captured image. The color of the captured image may be set based on the RGB values of the pixels in a portion surrounding the setting marker that is specified by the marker data. In the case where the color of the setting marker is set based on the color of the captured image, a color that is different from the color of the captured image may be set as the color of the setting marker. For example, a correspondence relationship between the color of the captured image and the color of the setting marker may be stored in advance in a storage device such as the EEPROM 144, and the color of the setting marker may be set based on the correspondence relationship with the color of the captured image. The color of the setting marker may be designated by the user. In that case, the user may easily check the setting marker within the composite image visually by taking the color of the sewing object 39 into account when setting the color of the setting marker. In a case where the setting marker is a marker in which a plurality of markers are combined, as it is in the above embodiments, the color of a portion of the markers that the setting marker includes may be set based on the color of the captured image, and the color of all of the markers may be set based on the color of the captured image.

(F) In the above embodiments, the specified data that are output from the touch panel 8 are acquired as various types of commands. The various types of commands may be acquired by a different method. For example, in a case where the sewing machine 1 includes an input device such as a mouse, specified data that are output by the input device may be acquired as the various types of commands. Various types of modifications may be made to the embroidery pattern. For example, an aggregation of a plurality of patterns may be used as a single embroidery pattern.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a needle bar that is configured to accept a needle at a lower end;

a needle plate in which a needle hole is provided, the needle hole being configured to allow the needle to pass through;

an image capture device that is configured to generate, as captured image data, data that describe a captured image of a sewing object being positioned between the needle bar and the needle plate;

a setting command acquisition device that is configured to acquire a setting command that is a command specifying a pattern position and a pattern angle, the pattern position being a position of a reference point of an embroidery pattern in relation to the sewing object, and the pattern angle being an angle of the embroidery pattern in relation to the sewing object;

a marker data generation device that is configured to generate, as marker data, data that describe a setting marker by setting the pattern position and the pattern angle in accordance with the setting command that has been acquired by the setting command acquisition device, the setting marker indicating the pattern position and the pattern angle, the setting marker being a marker in which a first marker and a second marker are combined, the first marker including lines forming a grid, each of the lines extending from one edge to another edge of a rectangle describing a size of the captured image, the second marker being a plus-shaped marker, a plus-shaped intersection point of the second marker being superimposed on one of intersection points of the lines forming the grid of the first marker, and the first marker being rotated around the one of the intersection points in accordance with the setting command that has been acquired by the setting command acquisition device;

a composite image data generation device that is configured to generate, as composite image data, data that describe a composite image based on the captured image data and the marker data, the composite image being an image in which the setting marker is superimposed on at least a portion of the captured image, in a position indicated by the marker data; and a display control device that, based on the composite image data, is configured to cause the composite image to be displayed on a screen.

2. The sewing machine according to claim 1, further comprising:

a first moving device that is configured to move an embroidery frame that holds the sewing object; and a first movement control device that, in a case where a command to set the pattern position has been acquired as the setting command by the setting command acquisition device, controls the first moving device to move the embroidery frame to a position that is in accordance with the setting command and in which the pattern position is located within an image capture area of the image capture device, wherein the image capture device generates the captured image data by image capture of the sewing object held by the embroidery frame moved by the first moving device.

3. The sewing machine according to claim 1, further comprising:

a second moving device that moves the image capture device; and a second movement control device that, in a case where a command to set the pattern position has been acquired as the setting command by the setting command acquisition device, controls the second moving device to move the image capture device to a position that is in accordance with the setting command and in which the pattern position is located within an image capture area of the image capture device, wherein the image capture device that has been moved by the second moving device generates the captured image data by image capture of the sewing object.

4. The sewing machine according to claim 1, wherein the image capture device generates the captured image data by image capture of a reference marker, the reference marker being a marker that has been created on the sewing object and that indicates a position to which the pattern position is to be set and an angle to which the pattern angle is to be set.

5. The sewing machine according to claim 1, further comprising:

a color acquisition device that acquires, as an image color, a color of the captured image based on the captured image data, wherein the marker data generation device generates the marker data by setting, in accordance with the image color that has been acquired by the color acquisition device, a color of the setting marker to a color that is different from the image color.

6. The sewing machine according to claim 1, further comprising:

an embroidery data acquisition device that acquires embroidery data for sewing the embroidery pattern; and a correction device that, based on the pattern position and the pattern angle, corrects the embroidery data that have been acquired by the embroidery data acquisition device.

7. A non-transitory computer-readable medium storing a control program executable on a sewing machine, the program comprising instructions that cause a computer of the sewing machine to perform the steps of:

causing an image capture device of the sewing machine to generate, as captured image data, data that describe a captured image of a sewing object being positioned between a needle bar of the sewing machine and a needle plate of the sewing machine;

acquiring a setting command that is a command specifying a pattern position and a pattern angle, the pattern position being a position of a reference point of an embroidery pattern in relation to the sewing object, the pattern angle being an angle of the embroidery pattern in relation to the sewing object;

generating, as marker data, data that describe a setting marker by setting the pattern position and the pattern angle in accordance with the setting command, the setting marker indicating the pattern position and the pattern angle, the setting marker being a marker in which a first marker and a second marker are combined, the first marker including lines forming a grid, each of the lines extending from one edge to another edge of a rectangle describing a size of the captured image, the second marker being a plus-shaped marker, a plus-shaped intersection point of the second marker being superimposed on one of intersection points of the lines forming the grid of the first marker, and the first marker being rotated around the one of the intersection points in accordance with the setting command;

generating, as composite image data, data that describe a composite image based on the captured image data and the marker data, the composite image being an image in which the setting marker is superimposed on at least a portion of the captured image, in a position indicated by the marker data; and causing the composite image to be displayed on a screen, based on the composite image data.

8. The non-transitory computer-readable medium according to claim 7, wherein:

the program further comprises instructions that cause the computer to perform the step of controlling a first moving device of the sewing machine to move a embroidery frame to a position that is in accordance with the setting command and in which the pattern position is located within an image capture area of the image capture device in a case where a command to set the pattern position has been acquired as the setting command, the first moving device being configured to move the embroidery frame that holds the sewing object, and the captured image data is generated by image capture of the sewing object held by the embroidery frame moved by the first moving device.

9. The non-transitory computer-readable medium according to claim 7, wherein:

the program further comprises instructions that cause the computer to perform the step of controlling a second moving device of the sewing machine to move the image capture device to a position that is in accordance with the setting command and in which the pattern position is located within an image capture area of the image capture device in a case where a command to set the pattern position has been acquired as the setting command, the second moving device moving the image capture device, and the image capture device that has been moved generates the captured image data by image capture of the sewing object.

10. The non-transitory computer-readable medium according to claim 7, wherein the captured image data is generated by image capture of a reference marker, the reference marker being a marker that has been created on the sewing object and that indicates a position to which the pattern position is to be set and an angle to which the pattern angle is to be set.

11. The non-transitory computer-readable medium according to claim 7, wherein:

the program further comprises instructions that cause the computer to perform the step of acquiring, as an image color, a color of the captured image based on the captured image data, the marker data is generated by setting, in accordance with the image color, a color of the setting marker to a color that is different from the image color.

12. The non-transitory computer-readable medium according to claim 7, wherein the program further comprises instructions that cause the computer to perform the steps of:

acquiring embroidery data for sewing the embroidery pattern; and correcting the embroidery data based on the pattern position and the pattern angle.

* * * * *